United States Patent [19]

Doshi

[11] 4,167,375

[45] Sep. 11, 1979

[54] POWER-CONVERTING DEVICE

[75] Inventor: Niranjan K. Doshi, Mehlville, Mo.

[73] Assignee: Frank Apostol, East St. Louis, Ill.

[21] Appl. No.: 845,882

[22] Filed: Oct. 27, 1977

Related U.S. Application Data

[63] Continuation-in-part of Ser. No. 684,537, May 10, 1976, Pat. No. 4,061,445.

[51] Int. Cl.[2] ..... F01C 1/02; F01C 19/04; F01C 21/00

[52] U.S. Cl. ..... 418/54; 418/122

[58] Field of Search ..... 418/54, 61 A, 122

[56] References Cited

U.S. PATENT DOCUMENTS

| | | | |
|---|---|---|---|
| 553,086 | 1/1896 | Wheildon | 418/54 |
| 1,310,157 | 7/1919 | DeCampo | 418/54 |
| 1,340,625 | 5/1920 | Planche | 418/54 |
| 3,029,741 | 4/1962 | Frager et al. | 418/54 |

FOREIGN PATENT DOCUMENTS

| | | | |
|---|---|---|---|
| 258 | of 1853 | United Kingdom | 418/54 |

*Primary Examiner*—John J. Vrablik

*Attorney, Agent, or Firm*—Rogers, Eilers & Howell

[57] ABSTRACT

A power-converting device has a generally-elliptical rotor which is mounted within a generally-cylindrical chamber. That rotor reciprocates as it rotates within that chamber; and interacting surfaces which are wholly separate from, displaced bodily away from, and in addition to the shaft of that power-converting device halt continued movement of that rotor whenever it reaches an end of its path of reciprocation, and then smoothly start that rotor moving back toward the opposite end of that path of reciprocation.

13 Claims, 19 Drawing Figures

POWER-CONVERTING DEVICE

This application is a continuation-in-part of my application Ser. No. 684,537 for Power-Converting Device which was filed on May 10, 1976 now U.S. Pat. No. 4,061,445.

BACKGROUND OF THE INVENTION

The positive-displacement, steam driven engine disclosed in my U.S. Pat. No. 3,873,245 has a generally-elliptical rotor mounted for rotation and reciprocation within a cylindrical chamber. That rotor tends to continue to move when it reaches an end of its path of reciprocation.

SUMMARY OF THE INVENTION

The power-converting device provided by the present invention has a generally-elliptical rotor which is mounted within a cylindrical chamber; and that rotor reciprocates as it rotates within that chamber. Interacting surfaces halt continued movement of that rotor whenever it reaches an end of its path of reciprocation, and then smoothly start that rotor moving back toward the opposite end of that path of reciprocation. In doing so, those interacting surfaces minimize wear, noise and frictional losses. Those interacting surfaces are wholly separate from, displaced bodily away from, and in addition to the shaft of the power-converting device. It is, therefore, an object of the present invention to provide interacting surfaces which halt continued movement of the rotor of a power-converting device when that rotor reaches an end of its path of reciprocation, and which are wholly separate from, displaced bodily away from, and in addition to the shaft of that power-converting device.

The interacting surfaces provided by the present invention include a generally-elliptical surface and at least one roller which abuts that generally-elliptical surface as the rotor reaches an end of its path of reciprocation. Both that generally-elliptical surface and that roller are displaced from the generally-cylindrical wall of the generally-cylindrical chamber and also from the shaft of that power-converting device. It is, therefore, an object of the present invention to provide a generally-elliptical surface and at least one roller which are displaced from the generally-cylindrical wall of the generally-cylindrical chamber and also from the shaft of a power-converting device and which abut as the rotor of that device reaches an end of its path of reciprocation.

Other and further objects and advantages of the present invention should become apparent from an examination of the drawing and accompanying description.

In the drawing and accompanying description several preferred embodiments of the present invention are shown and described but it is to be understood that the drawing and accompanying description are for the purpose of illustration only and do not limit the invention and that the invention will be defined by the appended claims.

DESCRIPTION OF THE PREFERRED EMBODIMENTS

Referring particularly to FIGS. 1-9, the numeral 30 generally denotes one of the side plates of one preferred embodiment of power-converting device which is provided by the present invention. That side plate is circular in configuration, and it has a circular opening 31 therein. However, as indicated particularly by FIG. 4, that opening is eccentric of the geometric center of that side plate.

Figure 4:
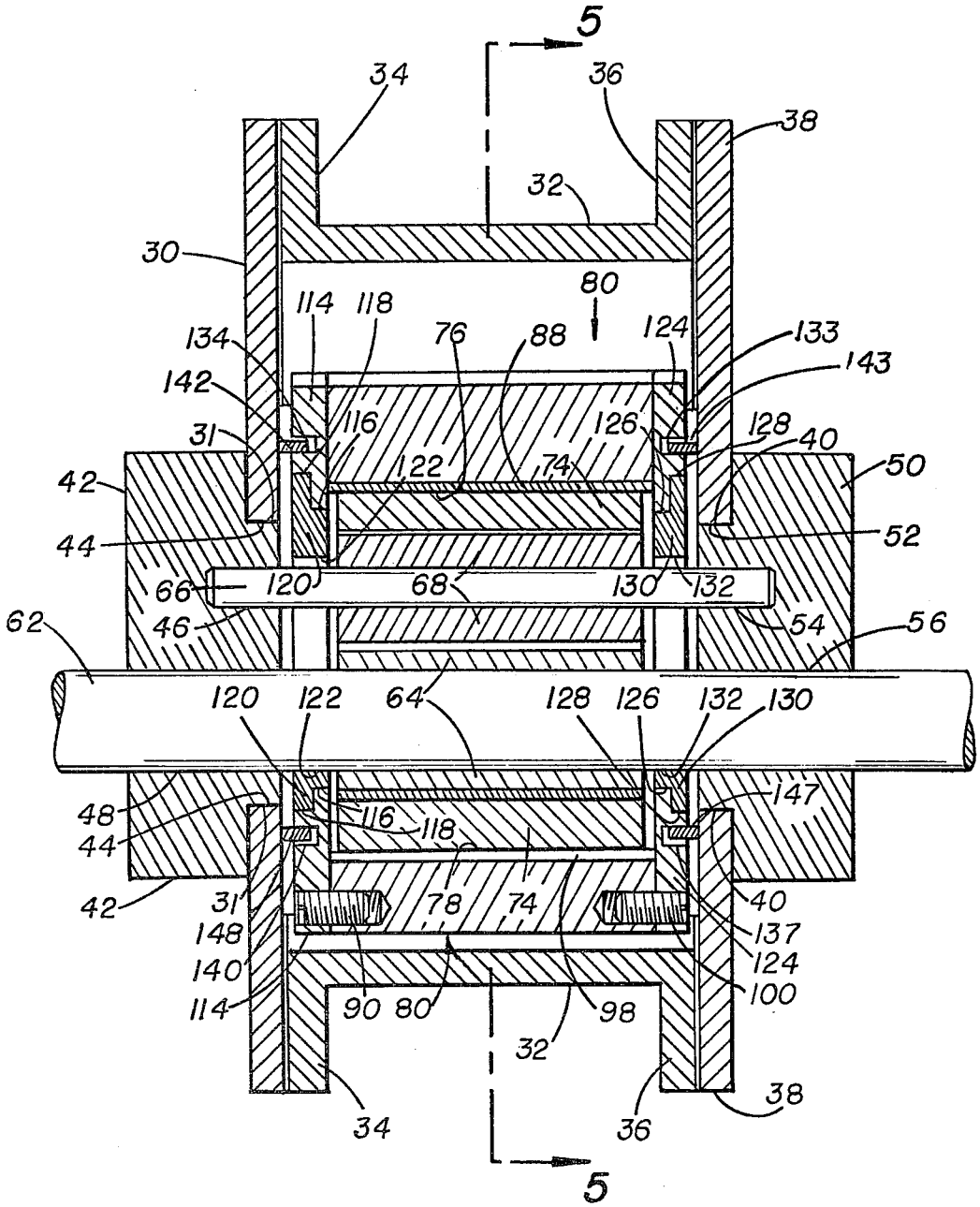
FIG. 4 is a sectional view through the device of FIG. 1, and it is taken along the broken plane indicated by the broken line 4—4 in FIG. 2.
Figure 5:
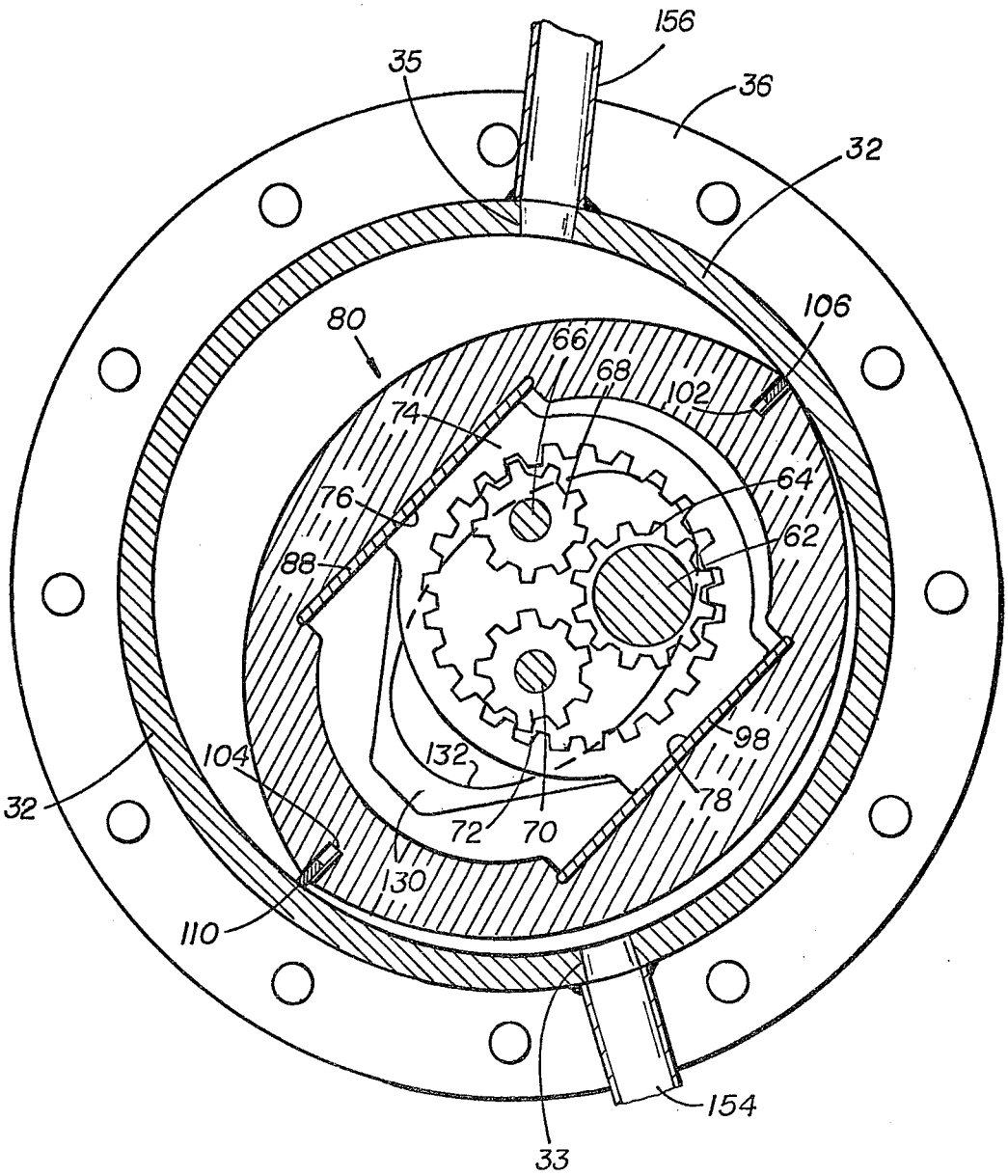
FIG. 5 is a further sectional view through the device of FIG. 1, and it is taken along the plane indicated by the line 5—5 in FIG. 4.

The numeral 32 denotes the cylindrical body of the device of FIGS. 1–9; and that cylindrical body has outwardly-extending annular flanges 34 and 36 at the opposite ends thereof. The numeral 33 denotes the inlet port for the cylindrical body 32; and the numeral 35 denotes the outlet port for that cylindrical body. As indicated by FIG. 5, those ports are spaced apart by an angle of about one hundred and eighty degrees.

The numeral 38 denotes a second side plate which preferably is identical to the side plate 30. The side plate 38 has an opening 40 therein; and that opening is eccentric of the geometric center of that side plate. The opening 40 has the same size as, and is coaxial with, the opening 31 in the side plate 30.

Annular gaskets, not shown, will be interposed between the outer faces of the flanges 34 and 36 and the inner faces of the side plates 30 and 38, respectively. Hexagonal-headed screws 58 will pass inwardly through circumferentially-spaced openings in the side plates 30 and 38 seat in threaded sockets in the flanges 34 and 36. Those hexagonal-headed screws will enable the gaskets to provide fluid-tight engagements between the inner faces of the side plates 30 and 38 and the outer faces of the flanges 34 and 36.

The numeral 42 denotes a cylindrical bearing which has a smaller-diameter cylindrical projection 44 thereon. That projection extends into, and is confined and held by, the opening 31 in the side plate 30. A socket 46 is provided in the inner surface of that bearing, and a passage 48 extends through the bearing, all as shown by FIG. 4. The numeral 50 denotes a cylindrical bearing which has a smaller-diameter cylindrical projection 52 thereon. That projection extends into, and is confined and held by, the opening 40 in the side plate 38. The numeral 54 denotes a socket in the inner face of the bearing 50 which is in register with the socket 46 in the inner face of the bearing 42. The numeral 56 denotes a passage in the bearing 50 which has the same diameter as, and which is coaxial with, the passage 48 in the bearing 42. Hexagonal-headed screws 60 extend inwardly through openings in the bearings 42 and 50 to seat in threaded sockets in the side plates 30 and 38.

The numeral 62 denotes the output shaft of the device shown by FIGS. 1–9; and that shaft is journalled within the passages 48 and 56, respectively, in the bearings 42 and 50. A spur gear 64 is mounted on the shaft and is suitably held against rotation relative to that shaft by a key and keyway, not shown, of conventional design and construction. The numeral 66 denotes a shaft which is journalled within th sockets 46 and 54 in the confronting faces of the bearings 42 and 50. A spur gear 68 is mounted on the shaft 66 and is suitably held against rotation relative to that shaft by a key and keyway, not shown, of conventional design and construction. The numeral 70 denotes a further shaft which is rotatably held within sockets, not shown, in the confronting faces of the bearings 42 and 50. A spur gear 72 is mounted on that shaft and is held against rotation relative to that shaft by a key and keyway, not shown, of conventional design and construction. As indicated particularly by FIGS. 2 and 5–9, the shafts 62, 66 and 70 are displaced far enough from each other so the teeth in the gears 64, 68 and 72 never engage each other.

The numeral 74 denotes a ring gear which has teeth at the inner surface thereof that are dimensioned to mesh with the teeth on all of the spur gears 64, 68 and 72. Those spur gears act to hold that ring gear against radial shifting while permitting that ring gear to rotate. Flat bearing surfaces 76 and 78 are provided at opposite sides of the ring gear 74, and convex surfaces are provided at the ends of that ring gear. In the preferred embodiment shown by FIGS. 1–9, the geometric axis of the ring gear 74 is located on a diameter of the cylindrical body 32; and that axis is located midway between the geometric center of that cylindrical body and the axis of the passages 48 and 56 in the bearings 42 and 50.

The numeral 80 generally denotes the rotor of the device of FIGS. 1–9; and that rotor is generally elliptical in side elevation, and it has a large opening at the center thereof. That opening has a concave surface at each end thereof; and those surfaces are larger than the convex surfaces at the ends of the ring gear 74. The large opening in the rotor 80 has a flat surface at each side thereof; and those surfaces have oil-impregnated bearing plates 88 and 98 fixedly secured thereto. Those oil-impregnated bearing plates engage the first bearing surfaces 76 and 78 of the ring gear 74, thereby forcing that ring gear to rotate with the rotor 80 while permitting that rotor to reciprocate relative to that ring gear. Those oil-impregnated bearing plates minimize frictional losses between the ring gear 74 and the rotor 80.

The numeral 102 denotes a slot at one end of the major axis of the rotor 80; and an apex seal 106 is disposed within that slot. The numeral 104 denotes a slot at the other end of the major axis of the rotor 80; and an apex seal 110 is disposed within that slot. An elongated spring, not shown, which preferably has accordion-like pleats therein, is disposed within the slot 102 to force the outer face of the apex seal 106 into continuous engagement with the inner surface of the cylindrical body 32. A similar spring, not shown, is disposed within the slot 104 to force the outer face of the apex seal 110 into continuous engagement with the inner surface of that cylindrical body.

The numeral 114 denotes a side plate which is secured to the rotor 80 by screws 90; and those screws effectively make that side plate a part of that rotor. That side plate has a generally diamond-shaped opening 116 therein; and it has a diamond-shaped recess 118 which is continguous with that opening and which confronts the side plate 30. The numeral 120 denotes a generally diamond-shaped oil-impregnated bearing plate which is dimensioned to fit within opening 116 and recess 118 in side plate 114. That bearing plate has a generally elliptical opening 122 therein; and, as shown particularly by FIGS. 2, 4 and 5, that generally elliptical opening abuts the surface of shaft 62.

The numeral 124 denotes a side plate which preferably is the mirror image of the side plate 114; and screws 100 secure that side plate to the rotor 80 so it effectively becomes a part of that rotor. The numeral 126 denotes a generally diamond-shaped opening within the side plate 124, and the numeral 128 denotes a generally diamond-shaped recess which is contiguous with that opening and which confronts the side plate 38. The numeral 130 denotes a generally diamond-shaped oil-impregnated bearing plate which is dimensioned to fit within opening 126 and recess 128 in side plate 124. That bearing plate has a generally elliptical opening 132 therein; and, as shown by FIG. 4, that generally elliptical opening abuts the surface of shaft 62.

Figure 1:
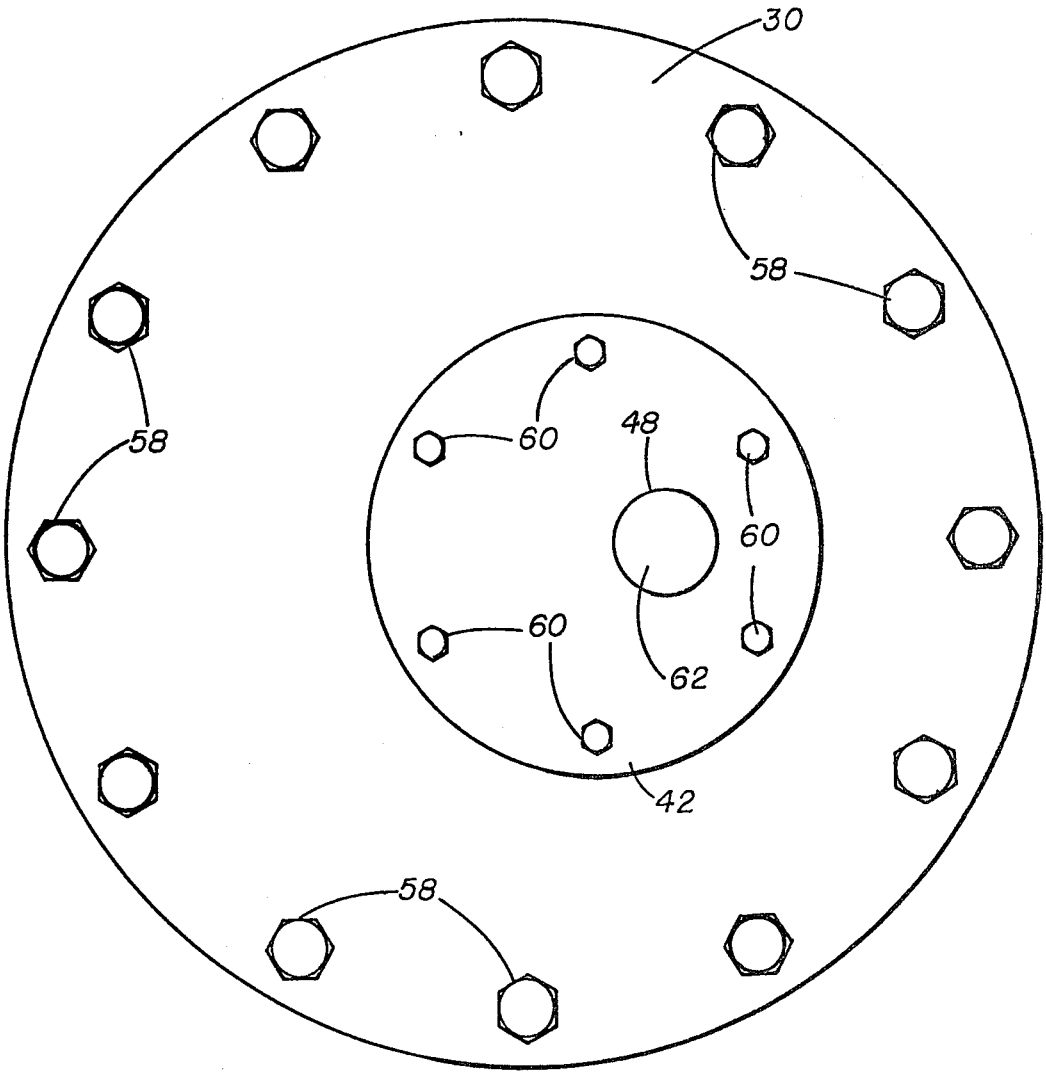
FIG. 1 is a side elevational view of one preferred embodiment of power-converting device which is made in accordance with the principles and teachings of the present invention.
Figure 2:
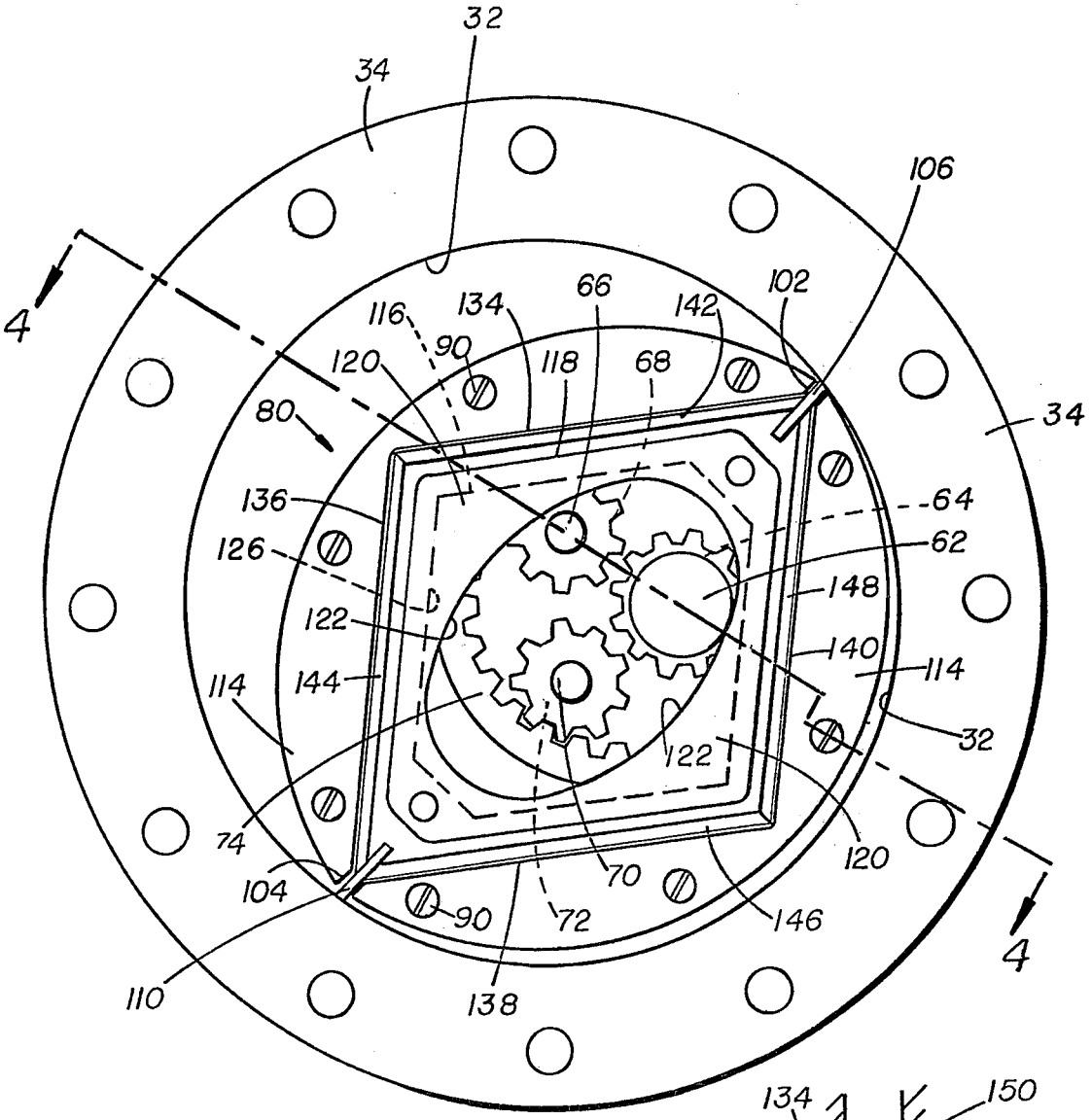
FIG. 2 is a side elevational view of the device of FIG. 1 after one of the side plates thereof has been removed.
Figure 3:
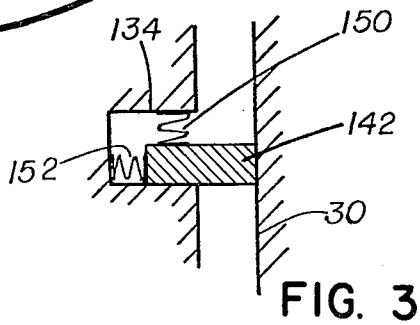
FIG. 3 is a sectional view, on a larger scale, through one of the side seals and through the adjacent portions of the rotor and of the side plate of the device of FIG. 1.

The numerals 134, 136, 138 and 140 denote straight grooves which are formed in the outer face of the side plate 114, as shown particularly by FIGS. 2 and 4. The adjacent ends of the grooves 134 and 136 are contiguous, and the remote ends of those grooves are contiguous with the slots 102 and 104. The adjacent ends of the grooves 138 and 140 are contiguous, and the remote ends of those grooves are contiguous with the slots 104 and 102. Straight side seals 142, 144, 146 and 148 are disposed, respectively, within the grooves 134, 136, 138 and 140. The adjacent ends of the side seals 142 and 144 abut each other, and the remote ends of those side seals are immediately adjacent the apex seals 106 and 110. The adjacent ends of the side seals 146 and 148 abut each other, and the remote ends of those side seals are immediately adjacent the apex seals 110 and 106. An elongated spring 150, which has accordion-like pleats therein, is disposed within the groove 134 to force one side of the seal 142 to continuous engagement with the adjacent side of that groove. A similar elongated spring 152 is disposed within that groove to force the outer face of that seal into continuous engagement with the inner surface of the side plate 30. Corresponding sets of springs, not shown, are disposed within each of the grooves 136, 138 and 140 to force one side of each of the side seals 144, 146 and 148 into continuous engagement with the adjacent sides of those grooves and to force the outer faces of those side seals into continuous engagement with the inner surface of the side plate 30.

Four straight grooves, which are identical to the grooves 134, 136, 138 and 140, are provided in the outer face of the side plate 124; and two of those grooves, namely, grooves 133 and 137 are shown in FIG. 4. Four straight side seals which are identical to the side seals 142, 144, 146 and 148 are disposed within the four straight grooves in the side plate 124; and two of those side seals, namely, side seals 143 and 147 are shown in FIG. 4. Sets of springs, not shown, which are comparable to the set of springs 150 and 152 are disposed within each of the four straight grooves in the side plate 124 to force one side of each of the four side seals into continuous engagement with the adjacent sides of those grooves and to force the outer faces of those side seals into continuous engagement with the inner surface of the side plate 38.

The spring 150 will bear against that side of groove 134 which is closer to the outer periphery of the rotor 80, and hence will urge the side seal 142 toward that side of the groove which is closer to the center of the rotor 80. Similarly, the seven springs, not shown, which are disposed within the straight slots 133, 136, 137, 138, 140 and the other two grooves, not shown, will bear against those sides of those grooves which are closer to the outer periphery of the rotor 80, and hence will urge the side seals 143, 144, 146, 147, 148 and the other two side seals, not shown, toward those sides of those grooves which are closer to the center of the rotor 80.

The numeral 154 denotes an inlet pipe which is secured to the cylindrical body 32 adjacent the inlet port 33; and the numeral 156 denotes an outlet pipe which is secured to that cylindrical body adjacent the outlet port 35. Those pipes are shown as being welded to that cylindrical body; but those pipes could be secured to that body by threaded connections or by any of the other ways customarily used by those skilled in the art. Where the power-converting device of FIGS. 1–9 is used as a fluid-driven engine, a suitable throttling valve will appropriately supply desired amounts of fluid to the pipe 154.

Figure 6:
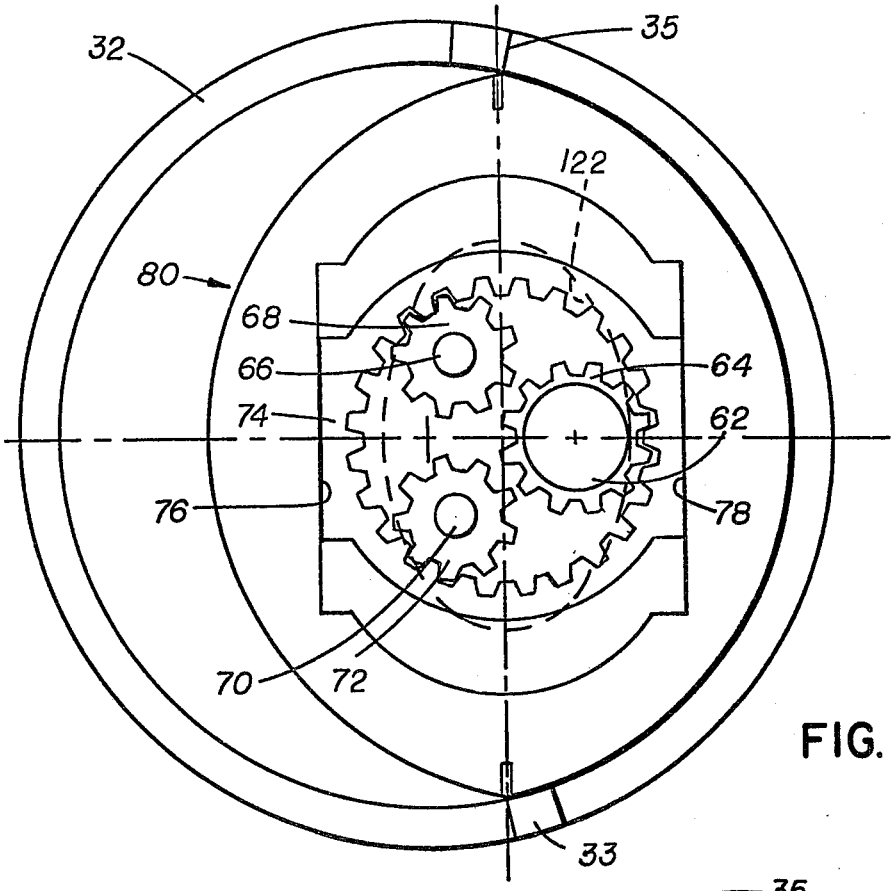
FIG. 6 is a kinematic view of the chamber and rotor of the device of FIG. 1, and it shows that rotor in its zero position.

Whenever the rotor 80 is in the zero position shown by FIG. 6, one-half of the periphery of that rotor will be immediately adjacent the right-hand inner surface of the cylindrical body 32. At that time, the concave surfaces at the ends of the large central opening in that rotor will be about equidistant from the ring gear 74. Also, at that time, the apex seals of that rotor will be adjacent the ports 33 and 35—one of those apex seals and the adjacent portion of the rotor 80 blocking the inlet port 33, and the other of those apex seals and the adjacent portion of that rotor leaving the outlet port 35 open. If the power-converting device is used as an engine, and if that engine is being started or is running, fluid will pass through pipe 154 and through inlet pipe 33 to urge the rotor 80 to rotate in the clockwise direction.

Figure 7:
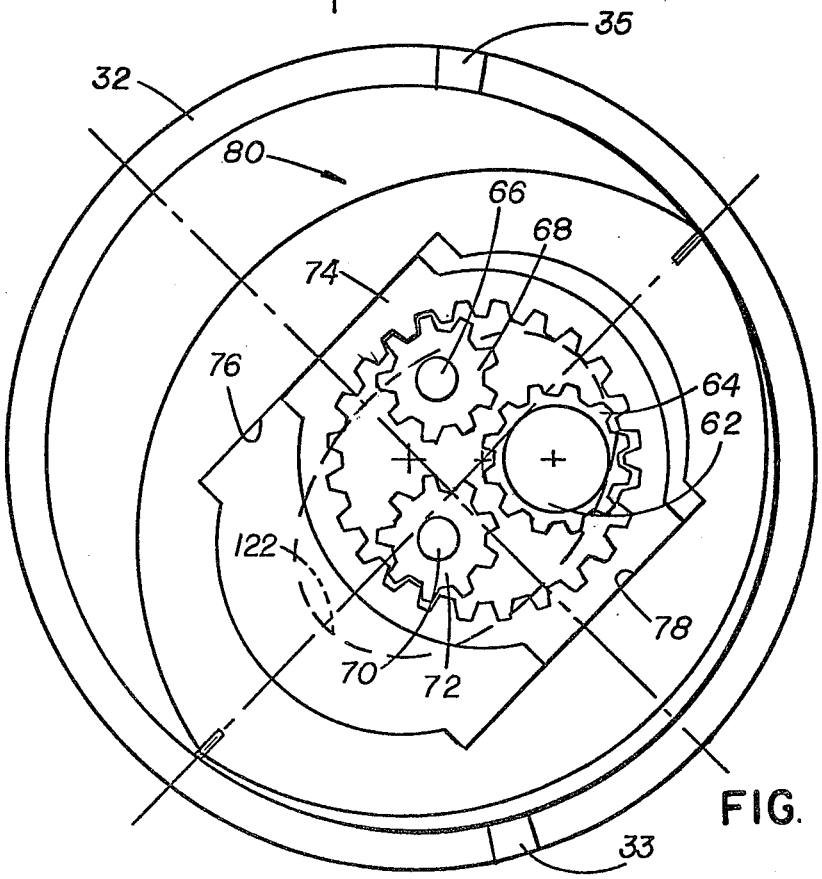
FIG. 7 is another kinematic view of the rotor and chamber of the device of FIG. 1, and it shows that rotor displaced forty-five degrees from the position of FIG. 6.

During the first forty-five degrees of rotation, the rotor 80 will progressively shift downwardly and to the left toward the position shown by FIG. 7. As that rotor so shifts, the distance between the geometric center of that rotor and the geometric center of the ring gear 74 will increase progressively; and will thereby progressively increase the effective rotative moment which the fluid causes that rotor to apply to that ring gear. Rotation of that ring gear will cause rotation of the spur gear 64, and hence will cause rotation of the output shaft 62.

Figure 8:
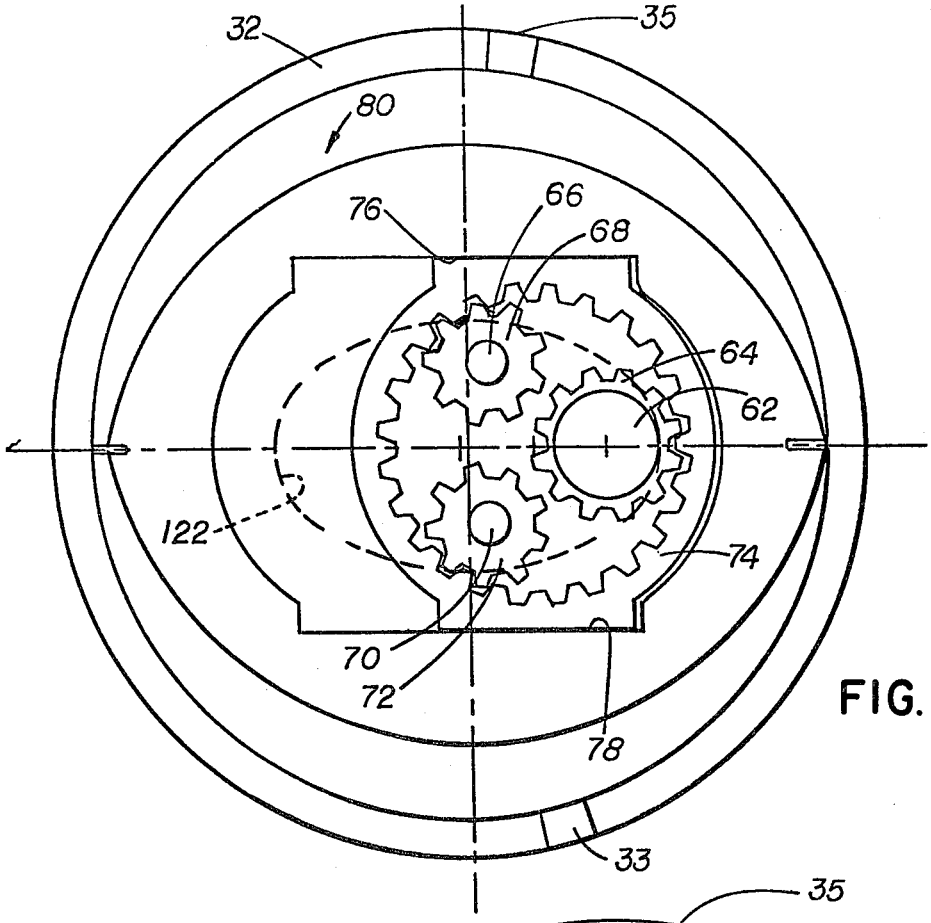
FIG. 8 is a further kinematic view of the rotor and chamber of FIG. 1, and it shows that rotor displaced ninety degrees from the position of FIG. 6.
Figure 9:
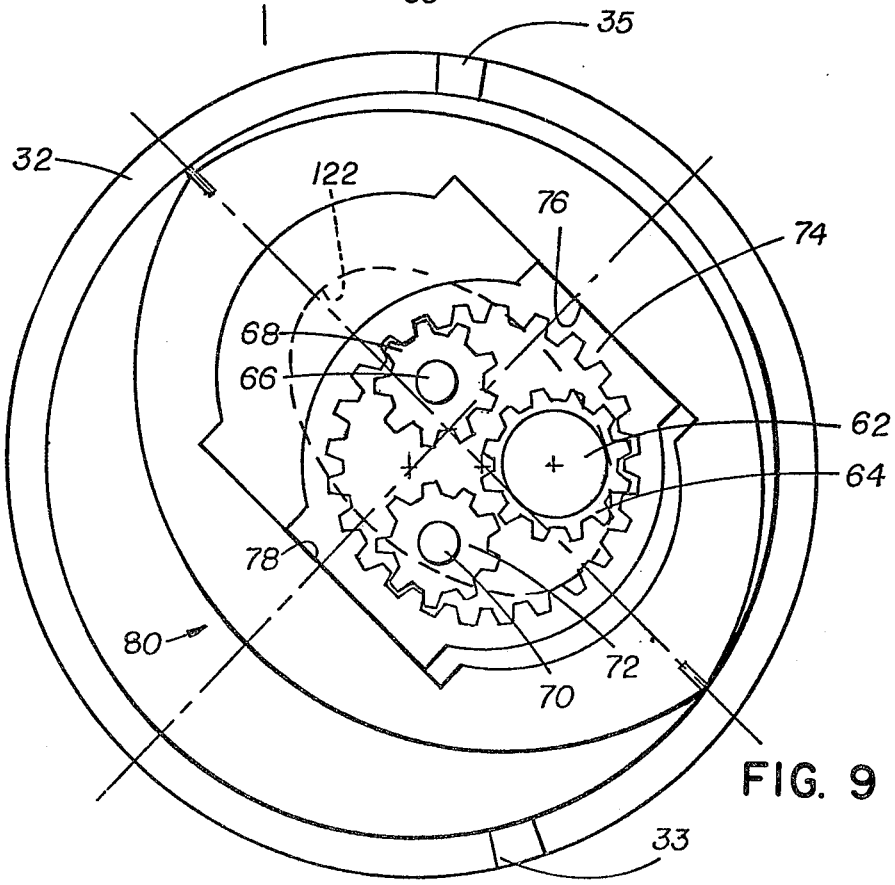
FIG. 9 is a still further kinematic view of the rotor and chamber of the device of FIG. 1, and it shows that rotor displaced one hundred and thirty-five degrees from the position of FIG. 6.

During the second forty-five degrees of rotation, the rotor 80 will progressively shift to the left toward the position of FIG. 8. As that rotor so shifts, the distance between the geometric center of that rotor and the geometric center of the ring gear 74 will increase progressively; and will thereby progressively increase the effective rotative moment which the fluid causes that rotor to apply to that ring gear. When that rotor reaches the position of FIG. 8, it will be at one end of its path of reciprocation; but its momentum will cause it to tend to continue to move to the left. The spring, not shown, within the slot at the left-hand end of the major axis of the rotor 80 will, of course, tend to resist continued left-hand movement of that rotor; but that spring will be wholly unable to halt that movement. However, as the rotor 80 approaches the position of FIG. 8, the surface at one end of the elliptical opening 122 in that rotor will abut the surface of the shaft 63; and those surfaces will interact to smoothly halt further movement of that rotor to the left. As a result, the wear, noise and frictional losses which would be experienced if the rotor 80 were to be permitted to move into engagement with the left-hand inner surface of the cylindrical body 32, are completely obviated.

As the fluid rotates the rotor 80 past the position of FIG. 8, the surface of the generally-elliptical opening 122 in that rotor will interact with the surface of the shaft 62 to force that rotor to start moving to the right—and hence back toward the opposite end of its path of reciprocation. Those surfaces will thus halt movement of the rotor 80 to the left and then start that rotor moving back to the right; and they will do so smoothly, quickly and with only small frictional losses. During the third forty-five degrees of rotation, the rotor 80 will progressively shift upwardly and to the right toward the position of FIG. 9. As that rotor so moves, the distance between the geometric center of that rotor and the geometric center of the ring gear 74 will decrease progressively; and hence the moment arm of the force which fluid causes that rotor to apply to that ring gear will be decreased progressively. However, at the time the rotor 80 reaches the position of FIG. 9, the distance between the geometric center of that rotor and the geometric center of that ring gear will be only slightly less than its maximum value.

During the fourth forty-five degrees of rotation, the rotor 80 will continue to shift to the right and toward the position of FIG. 6. When that rotor reaches that position, the half of the periphery of that rotor which was remote from the right-hand portion of the inner surface of cylindrical body 32 in FIG. 6 will be immediately adjacent that right-hand portion. Further, the apex seal which coacted with an adjacent portion of that rotor to overlie the inlet port 33 will be disposed to the right of the outlet port 35 to permit fluid to issue from that outlet port. Also, at such time, the apex seal which had coacted with an adjacent portion of that rotor to leave the outlet port 35 open will be adjacent the inlet port 33.

During the rotation of the rotor 80 from the position of FIG. 6 through one hundred and eighty degrees of that position again, the ring gear 74 also rotated one hundred eighty degrees. However, the spur gear 64 and the output shaft 62 rotated through a greater number of degrees. The ratio of rotation of the output shaft 62 to the rotation of the ring gear 74 will be the same as the ratio of the pitch diameter of that ring gear to the pitch diameter of spur gear 64.

As the rotor 80 reaches the position of FIG. 6, further fluid will pass through the inlet port 33 to cause further clockwise rotation of that rotor. The continuing rotation of that rotor will cause continuing rotation of the output shaft 62. During each revolution of the rotor 80, the momentum of that rotor will tend to cause that rotor to move to the left beyond the position of FIG. 8; but the surface at the appropriate end of the elliptical opening 122 will coact with the surface of the output shaft 62 to prevent any such movement. Moreover, those surfaces will interact to force that rotor to start moving back to the right as it rotates past the ninety degree position of FIG. 8. The halting of the left-hand movement, and the starting of the right-hand movement, of the rotor 80 will be done smoothly and quietly; and hence wear, noise and frictional losses will be reduced.

The fluid which forces the rotor 80 to rotate and to reciprocate within the cylindrical body 32 will contact the radially-outer faces of the straight side seals 142, 143, 144, 146, 147, 148 and the other two straight side seals, not shown. In doing so, that fluid will apply inwardly-acting forces to those side seals which will be added to the forces which the spring 150 and its counterparts apply to the sides of those side seals. As a result, fluid-tight sealing engagements will be maintained continuously between those side seals and the adjacent sides of the straight grooves therefor.

Figure 10:
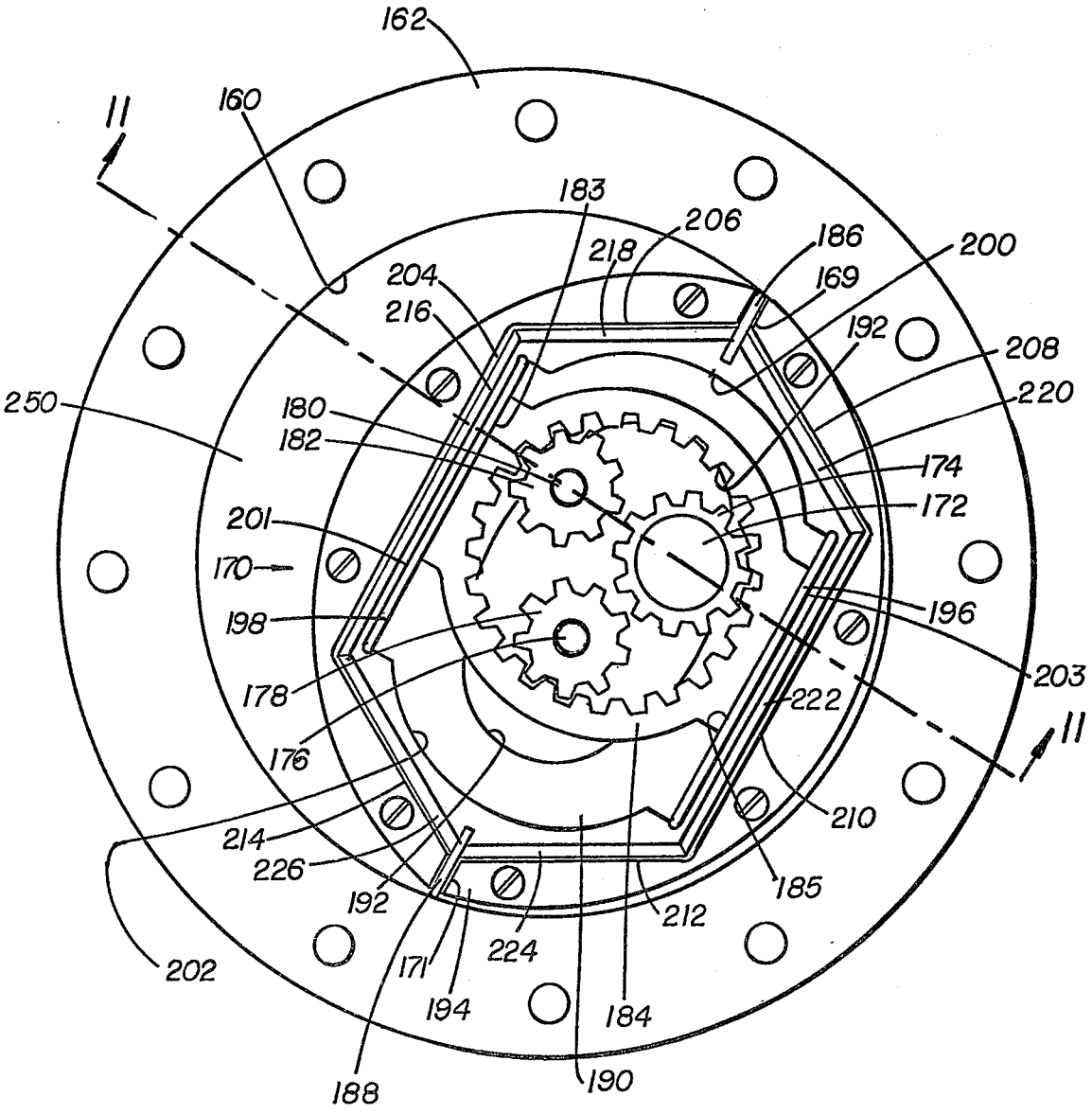
FIG. 10 is a side elevational view of a second preferred embodiment of power-converting device provided by the present invention, and it shows that device after one of the side plates thereof has been removed.
Figure 11:
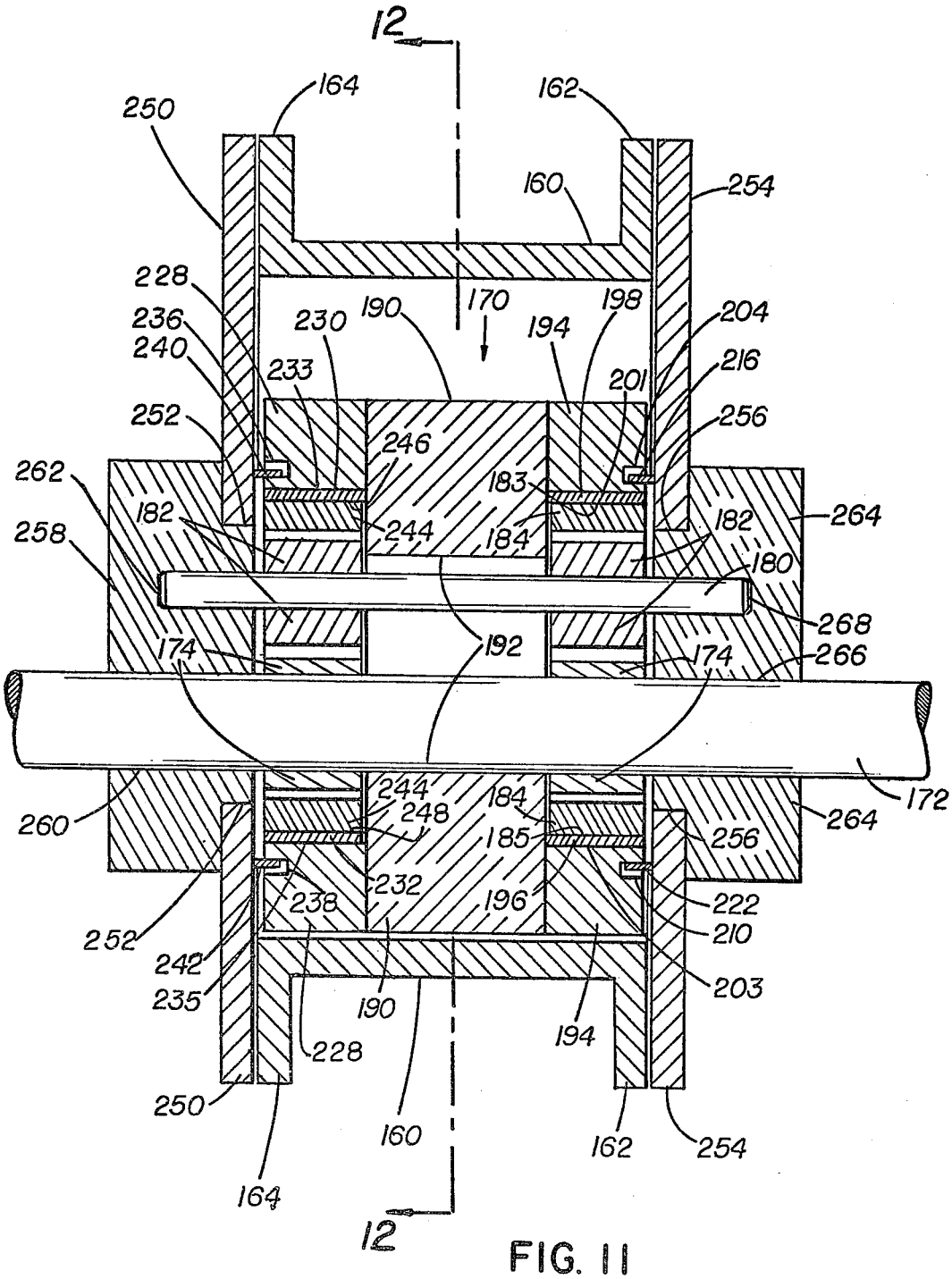
FIG. 11 is a sectional view through the device of FIG. 10, and it is taken along the plane indicated by the line 11—11 in FIG. 10.
Figure 12:
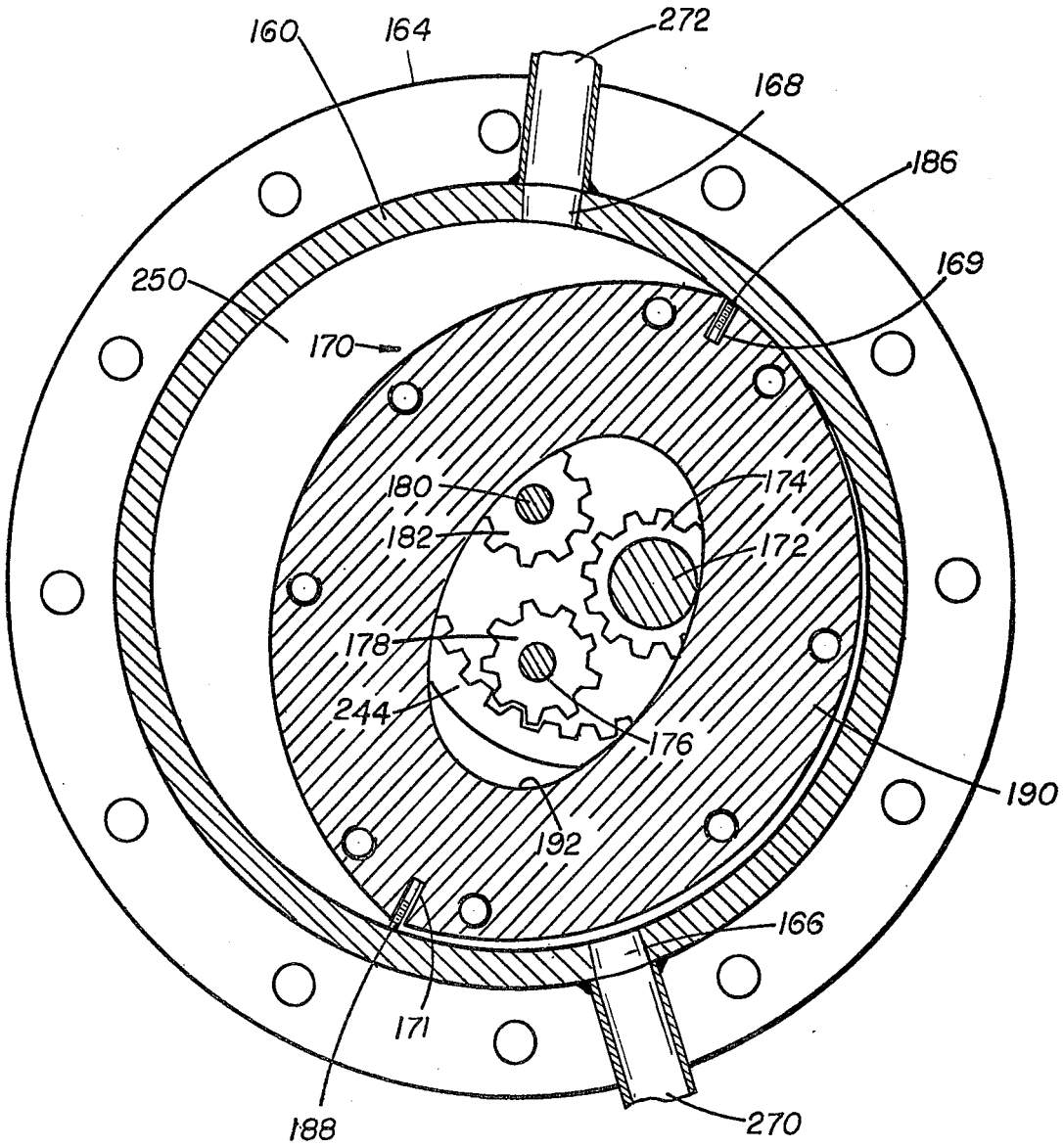
FIG. 12 is another sectional view through the device of FIG. 10, and it is taken along the plane indicated by the line 12—12 in FIG. 11.

Referring particularly to FIGS. 10–12, the numeral 160 denotes a cylindrical body which has outwardly-extending annular flanges 162 and 164 at the opposite ends thereof. An inlet port 166 extends through that cylindrical body; and an outlet port 168 extends through that cylindrical body at a point which is displaced almost one hundred and eighty degrees from that inlet port.

The numeral 170 generally denotes a generally-elliptical rotor which has a center section 190, a side plate 194 bolted to one side of that center section, and a side plate 228 bolted to the other side of that center section. The numeral 169 denotes a slot adjacent one end of the major axis of the rotor which extends through side plate 194, center section 190, and side plate 228 to constitute a continuous slot for an apex seal 186. The numeral 171 denotes a slot adjacent the other end of the major axis of the rotor which extends through side plate 194, center section 190, and side plate 228 to constitute a continuous slot for an apex seal 188. As indicated particularly by FIG. 11, the center section 190 has a large generally-elliptical opening 192 therein. As indicated particularly by FIG. 10, the side plate 194 has a large opening which is defined by a concave surface 200, a second concave surface 202, and two straight surfaces 201 and 203. An oil-impregnated flat bearing 196 abuts the straight surface 203, and a similar oil-impregnated flat bearing 198 abuts the straight surface 201.

The side plate 194 has straight slots 204, 206, 208, 210, 212 and 214 in the outer face thereof. Slot 214 is contiguous with the slot 171 and with the slot 204; and the latter slot is contiguous with the slot 206 which is contiguous with the slot 169. Slot 208 is contiguous with the slot 169 and with slot 210; and the latter slot is contiguous with slot 212 which is contiguous with the slot 171. Straight side seals 216, 218, 220, 222, 224 and 226 are disposed, respectively, within the slots 204, 206, 208, 210, 212 and 214. Suitable springs, not shown, will be disposed within those slots to urge those side seals against one side of those slots and also outwardly against the inner surface of the side plate 254.

The side plate 228 is a mirror image of the side plate 194. Specifically, the former side plate has a large opening which is defined by a concave surface 234 and a concave surface comparable to the concave surface 202 and by two straight surfaces 233 and 235. An oil-impregnated flat bearing 230 abuts the straight surface 233, and a similar oil-impregnated flat bearing 232 abuts the straight surface 235. As shown by FIG. 11, the straight surfaces 201 and 233 of the side plates 194 and 228 are co-planar; and so are the straight surfaces 203 and 235 of those side plates, the oil-impregnated flat bearings 198 and 230, and the oil-impregnated flat bearing 196 and 232. The side plate 228 has six straight slots in the outer face thereof which are in register with, but which face away from, the six slots 204, 206, 208, 210, 212 and 214 in the side plate 194; but only two of those slots, namely, slots 236 and 238 are shown in FIG. 11. Six straight side seals, which are comparable to the straight side seals 216, 218, 220, 222, 224 and 226 are disposed within the six slots in the side plate 228; but only two of those straight side seals, namely, straight side seals 240 and 242 are shown in FIG. 11.

The numeral 250 denotes a side plate for the engine which is circular and which has a circular opening 252 therein; but that opening is eccentric of the geometric axis of that side plate. The numeral 254 denotes the other side plate for the device; and it is circular and has a circular opening 256 therein which is eccentric of the geometric axis of that side plate. The side plate 250 will have a gasket between its periphery and that of the flange 164; and the side plate 254 will have a gasket between its periphery and that of the flange 152. A cylindrical bearing 258 has a cylindrical projection at the inner face thereof which is seated within the opening 252 in the side plate 250; and that bearing has a passage 260, a socket 262, and a further socket, not shown. The numeral 264 denotes a cylindrical bearing which has a smaller diameter cylindrical projection at the inner face thereof which is seated within the opening 256 in the side plate 254; and that bearing has a passage 266, a socket 268, and a further socket, not shown. The passages 260 and 266 are coaxial; and so are the sockets 262 and 268, and the further sockets, not shown.

The numeral 172 denotes an elongated shaft which is journalled within the passages 260 and 266 of bearings 258 and 264. That shaft passes through the generally-elliptical opening 192 in the center section 190 of the rotor 170, and also passes through the large openings in the side plates 194 and 228 of that rotor. Spur gears 174 are suitably secured to that shaft at opposite sides of the center section 190 by keys and keyways, not shown. A shaft 176 is journalled within the further sockets, not shown, in the bearings 258 and 264; and spur gears 178 are suitably secured to that shaft at opposite sides of the center section 190 by keys and keyways, not shown. The numeral 180 denotes a shaft which is journalled within the sockets 262 and 268 in the bearings 258 and 264; and spur gears 182 are suitably secured to that shaft at opposite sides of the center section 190 by keys and keyways, not shown. As shown particularly by FIGS. 10 and 12, the shafts 172, 176 and 180 are spaced far enough apart so the spur gears 174, 178 and 182 thereon can not engage or interfere with each other. The numeral 184 denotes a ring gear that meshes with those gears 174, 178 and 182 which are located adjacent the right-hand face of the center section 190 of the rotor 170 in FIG. 11. That ring gear has straight bearing faces 183 and 185 which engage, but which can reciprocate relative to, the oil-impregnated flat bearings 198 and 196, respectively.

The numeral 244 denotes a similar ring gear that meshes with those gears 174, 178 and 182 which are located adjacent the left-hand face of the center section 190 of rotor 170 in FIG. 11. That ring gear has straight bearing faces 246 and 248 which engage, but which can reciprocate relative to, the oil-impregnated flat bearings 230 and 232.

The numeral 270 denotes a pipe which is connected to the cylindrical body 160 so it is in communication with the inlet port 166. That pipe is shown as being welded to that cylindrical body; but it could easily be secured to that cylindrical body by any of the methods customarily used in the art.

The numeral 272 denotes a pipe which is connected to the cylindrical body 160 so it is in communication with the outlet port 168. That pipe is shown as being welded to that cylindrical body; but it could easily be secured to that cylindrical body by any of the methods customarily used in the art.

The two sets of gears 174, 178 and 182 fix the radial positions of the ring gears 184 and 244 but permit those ring gears to rotate relative to the cylindrical body 160. Those ring gears permit the rotor 170 to reciprocate relative to them, and also enable that rotor to rotate relative to that cylindrical body.

The application of fluid to pipe 270, and hence to inlet port 166, will cause the rotor 170 to rotate in the clockwise direction in FIGS. 10 and 12; and that rotor will force the ring gears 184 and 244 to rotate with it. Those ring gears will act through the spur gears 174 to rotate the shaft 172; and the spur gears 178 and 182 will act as positioning gears rather than output gears.

During each half-revolution of the rotor 170, it will shift to the left in FIGS. 10 and 12 as it approaches a position wherein it is displaced ninety degrees away from its zero position; and its momentum will cause it to tend to continue to move to the left. However, the surface at one end of the generally-elliptical opening 192 in the center section 190 of the rotor 170 will abut the surface of the shaft 172 and those surfaces will interact to smoothly halt further movements of that rotor to the left. As a result, the wear, noise and frictional losses which would be experienced if the rotor 170 were to be permitted to move into engagement with the left-hand inner surface of the cylindrical body 160 are completely obviated.

As the fluid rotates the rotor 170 past its ninety degrees position, the surface of the generally-elliptical opening 192 in rotor section 190 will interact with the surface of the shaft 172 to force that rotor to start moving to the right—and hence back toward the opposite end of its path of reciprocation. Those surfaces will thus halt movement of the rotor 170 to the left and then start that rotor moving back to the right; and they will do so smoothly, quietly and with only small frictional losses.

The primary difference between the structure in FIGS. 10–12 and the structure in FIGS. 1–5 is the location of the generally-elliptical surfaces which coact with the output shafts to halt left-hand movement of the rotors as those rotor approach and pass through their ninety degree positions. In the structure of FIGS. 1–5, two generally-elliptical surfaces 122 and 132 are provided at the opposite sides of the rotor 80, whereas in the structure of FIGS. 10–12, one wide generally-elliptical surface 192 is provided at the axial midpoint of the rotor 170. In addition, the spur gears 64, 68 and 72 are disposed axially inwardly of the rotor 80 in the structure of FIGS. 1–5, whereas the sets of gears 174, 178 and 182 are disposed adjacent the outer faces of the rotor 170 in the structure of FIGS. 10–12. With those exceptions, the function and operation of the structure of FIGS. 10–12 will be essentially identical to the function and operation of the structure of FIGS. 1–5.

Figure 13:
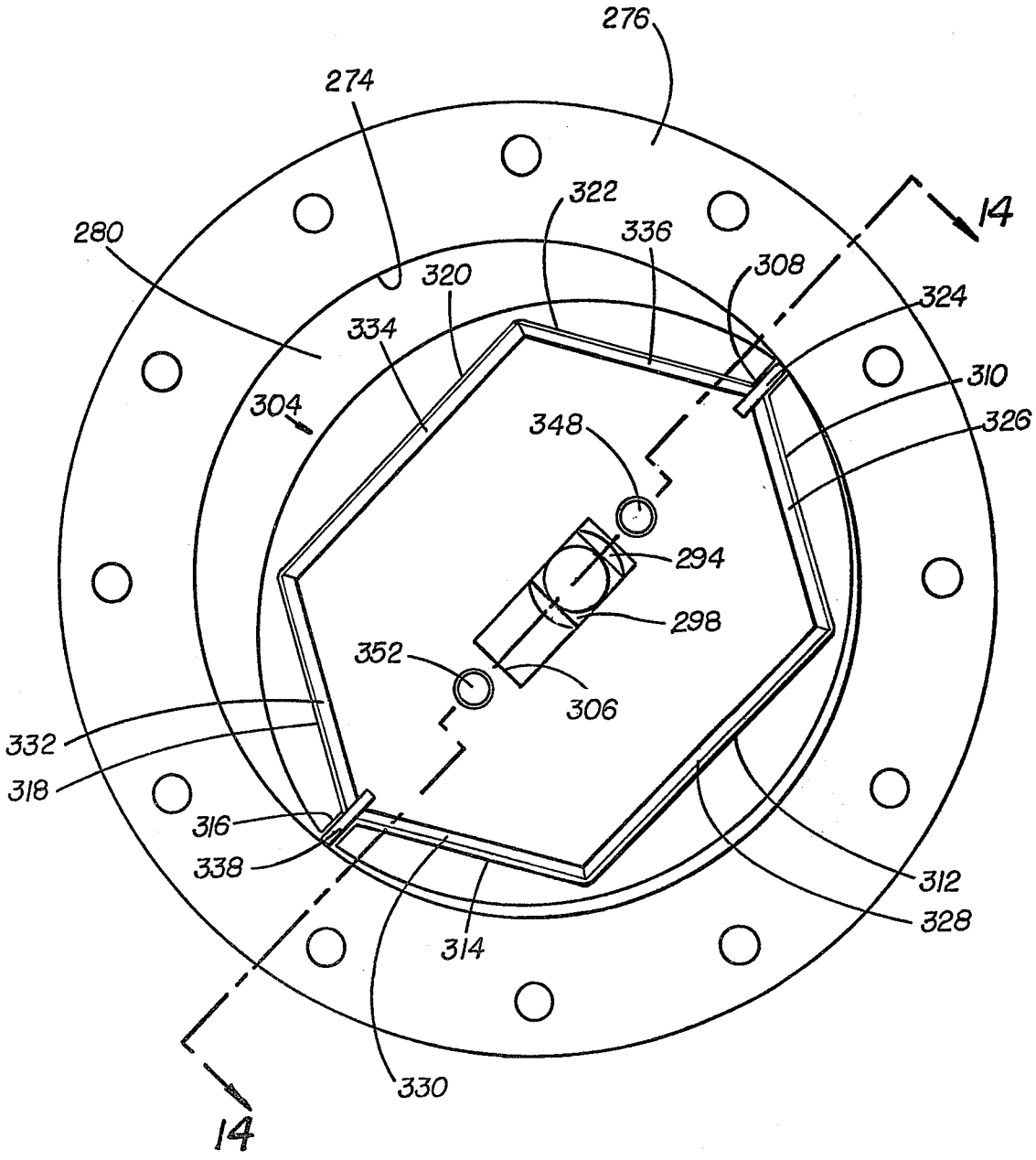
FIG. 13 is a side elevational view of a third preferred embodiment of power-converting device provided by the present invention, and it shows that device after one of the side plates thereof has been removed.
Figure 14:
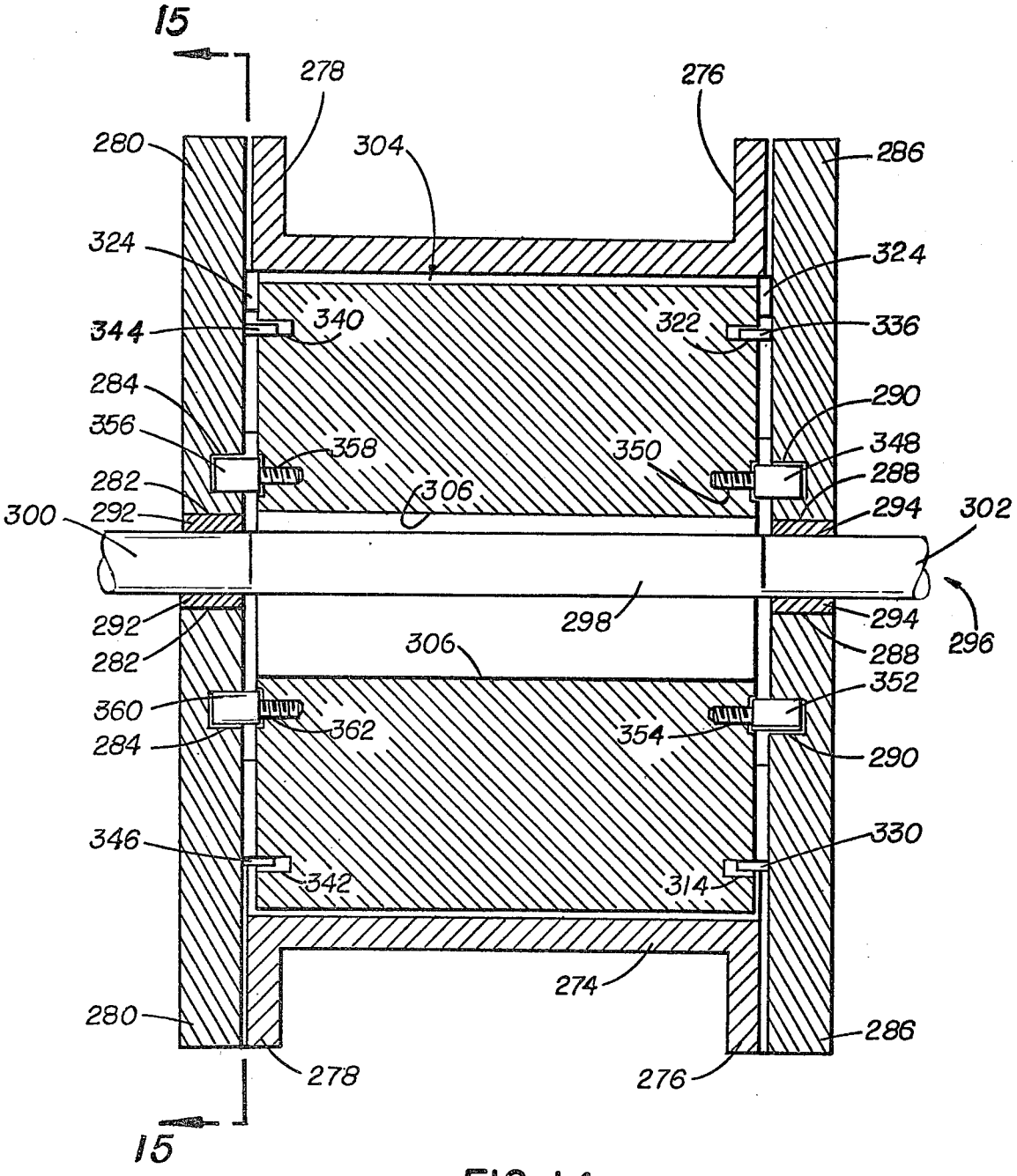
FIG. 14 is a sectional view through the device of FIG. 13, and it is taken along the broken plane indicated by the broken line 14—14 in FIG. 13.
Figure 15:
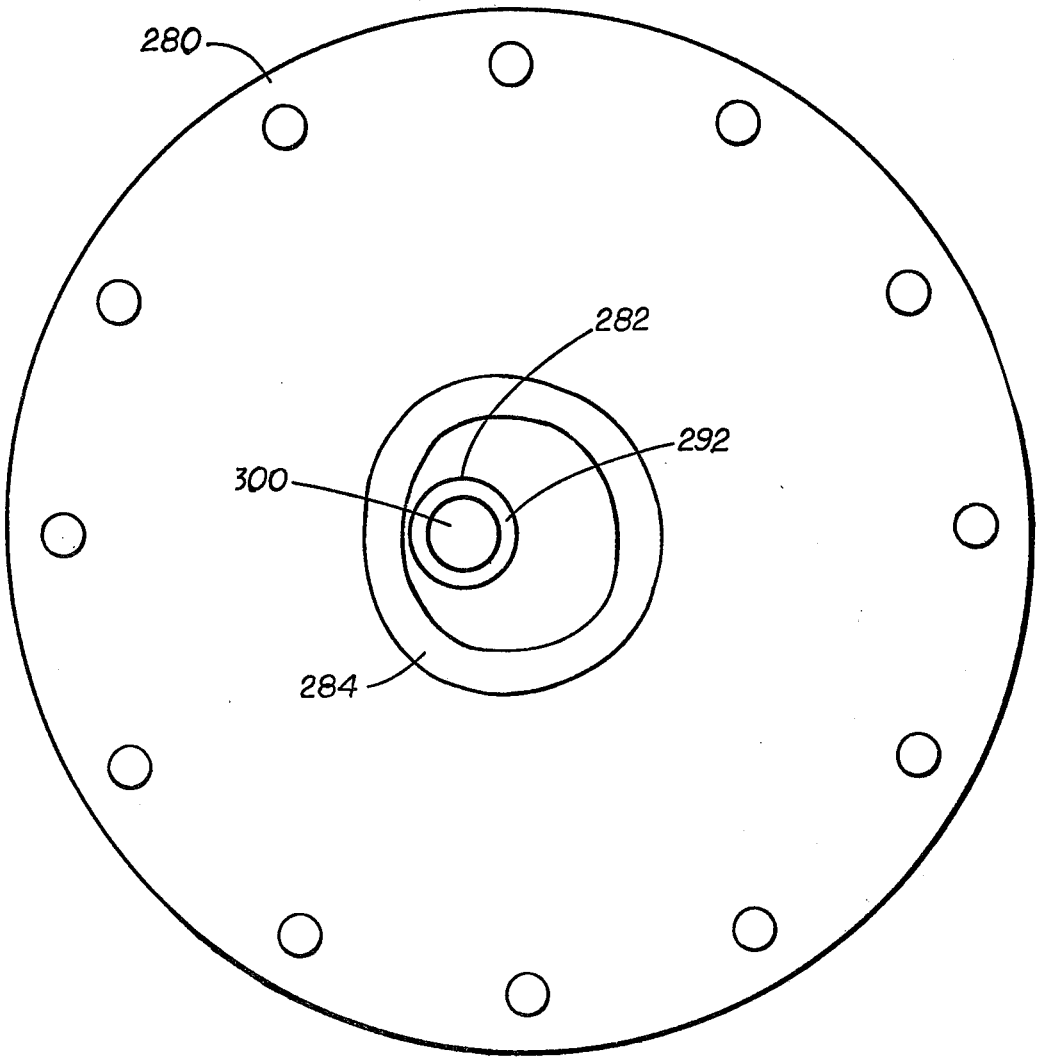
FIG. 15 is another sectional view through the device of FIG. 13, and it is taken along the plane indicated by the line 15—15 in FIG. 14.

Referring particularly to FIGS. 13–15, the numeral 274 denotes a cylindrical body that has outwardly-extending annular flanges 276 and 278 at the ends thereof. A side plate 280 with an opening 282 therein will have a gasket intermediate the periphery of the inner face thereof and the flange 278. A side plate 286 with an opening 288 therein will have a gasket intermediate the periphery of the inner face thereof and the flange 276. The openings 282 and 288 are coaxial, but they are eccentric of the geometric centers of the side plates 280 and 286. The numeral 284 denotes a groove in the inner face of side plate 280 which is rectangular in cross section and which is generally-elliptical in configuration, as shown by FIG. 15. The numeral 290 denotes a groove in the inner face of side plate 286 which is the mirror image of groove 284.

The numeral 292 denotes a bearing which is disposed within the opening 282 in side plate 280; and the numeral 294 denotes a bearing which is disposed within the opening 288 in side plate 286. Those bearings accommodate the circular outer ends 300 and 302 of a shaft 296 which has the center portion 298 thereof square in cross section.

The numeral 304 denotes a generally-elliptical rotor which is mounted on the central portion 298 of the shaft 296, by having that portion extend through a rectangular slot 306 in that rotor. The numerals 308, 310, 312, 314, 316, 318, 320 and 322 denote seal-receiving slots and grooves in one face of that rotor. The grooves 310, 312, 314, 318, 320 and 322 generally define a hexagon; and the slots 308 and 316 accommodate apex seals 324 and 328, respectively. Straight side seals 326, 328, 330, 332, 334 and 336 are disposed, respectively, within the straight grooves 310, 312, 314, 318, 320 and 322. Suitable springs, not shown, will urge those straight side seals against one side of those grooves and also against the inner surface of the side plate 286.

Six straight grooves are provided in the left-hand face of the rotor 304, as that rotor is viewed in FIG. 14; but only two of those grooves, namely, 340 and 342, are shown in FIG. 14. Those six straight grooves will be in register with, but will face away from, the six straight grooves in the righthand face of that rotor. Six straight side seals will be disposed within the six straight grooves in the left-hand face of rotor 304; but only two of those seals, namely, 344 and 346 are shown in FIG. 14. Those six straight side seals will be in register with, but will face away from, the six straight side seals in the six straight grooves that are in the right-hand face of rotor 304.

The numeral 348 denotes a roller-type cam follower which has a threaded shank 350 that is seated within a threaded socket in the right-hand face of rotor 304. The numeral 352 denotes a similar cam follower which has the threaded shank 354 thereof seated within a threaded socket in that right-hand face. The numeral 356 denotes a similar cam follower which has the threaded shank 358 thereof disposed within a threaded socket in the left-hand face of the rotor 304; and that threaded socket is in register with the threaded socket that receives the threaded shank 350. The numeral 360 denotes a similar cam follower which has the threaded shank 362 thereof disposed within a threaded socket in the left-hand face of rotor 304; and that threaded socket is in register with the threaded socket which accommodates threaded shank 354.

The power-converting device of FIGS. 13–15 is similar to the single-rotor positive-displacement steam engine of my said patent. However, the surfaces of the cam grooves 284 and 290 in the inner faces of the side plates 280 and 286 coact with the surfaces of the cam followers 348,352, 356 and 360, which are mounted on the rotor 304, to halt left-hand movement of that rotor when that rotor reaches the end of its path of reciprocation in its ninety degree position. Moreover, those surfaces interact to cause that rotor to start moving back to the other end of that path of reciprocation. As a result, where the power-converting device of FIGS. 13–15 is used as a fluid driven engine, it will operate more smoothly, with less noise, and with more efficiency than does the single-rotor steam engine of said patent. In all other respects, however, the device of FIGS. 13–15 will function and operate in essentially the same manner in which that single-rotor steam engine functions and operates.

The generally-elliptical surface 122 and the generally-elliptical surface 132 of FIGS. 2 and 4–9 are dimensioned so each of them abuts a portion of the surface of the output shaft 62 in every proper position of rotor 80. As a result, those generally-elliptical surfaces will coact with axially-spaced portions of the surface of output shaft 62 to prevent undesired shifting of that rotor toward any part of the left-hand inner surface of the cylindrical body 32 in every proper position of that rotor. Similarly, the generally-elliptical surface 192 of FIGS. 10–12 is dimensioned so it abuts a portion of the surface of the output shaft 172 in every proper position of rotor 170. As a result, that generally-elliptical surface will coact with a portion of the surface of output shaft 170 to prevent undesired shifting of that rotor toward any part of the left-hand inner surface of the cylindrical body 160 in every proper position of that rotor. Further, the generally-elliptical groove 284 of FIGS. 13–15 is dimensioned so its surfaces abut the surfaces of the cam followers 356 and 360, and the generally-elliptical groove 290 is dimensioned so its surfaces abut the surfaces of the cam followers 348 and 352 in every proper position of rotor 304. As a result, the surfaces of those generally-elliptical grooves will coact with the surfaces of those cam followers to prevent undesired shifting of that rotor toward any part of the left-hand inner surface of the cylindrical body 274 in every proper position of that rotor. However, if desired, the large radius elongated sides of the generally-elliptical surfaces 122 and 132 of FIGS. 2 and 4–9 could be dimensioned so some portions of those sides would not abut portions of the surface of the output shaft 62. Where that was done, the ends of those large radius elongated sides and the small radius ends of those generally-elliptical surfaces would, as the rotor 80 approached and passed through its forty degree through one hundred and forty degree positions, abut axially-spaced portions of the surface of output shaft 62 to prevent undesired shifting of that rotor to the left. Similarly, if desired, the large radius elongated sides of the generally-elliptical surface 192 of FIGS. 10–12 could be dimensioned so some portions of those sides would not abut portions of the surface of the output shaft 172. Where that was done, the large radius elongated sides and the small radius ends of that generally-elliptical surface would, as the rotor 170 approached and passed through its forty degree through one hundred and forty degree positions, abut portions of the surface of output shaft 172 to prevent undesired shifting of that rotor to the left. Again, if desired, the large radius, elongated, radially-outward sides of the generally-elliptical grooves 284 and 290 of FIGS. 13–15 could be dimensioned so some portions of those sides would not abut portions of the surfaces of the cam followers 356 and 360 or of the cam followers 348 and 352. Where that was done, the large radius elongated sides and the small radius ends of those radially-outward sides would, as the rotor 304 approached and passed through its forty degree through one hundred and forty degree positions, abut portions of the surfaces of the cam followers 356 and 360 or of the cam followers 348 and 352 to prevent undesired shifting of that rotor to the left. All of this means that none of the rotors 80,, 172 and 304 requires special restraint against continued movement along its path of reciprocation, and none of those rotors requires special aid in reversing its direction of reciprocation, until it approaches and passes through its forty degree through one hundred and forty degree positions, and it further means that each of the embodiments of the present invention provides such special restraint and special aid as the rotor thereof reaches and passes through its forty degree through one hundred and forty degree positions. For clarity, it will be understood that the forty degree position of each of those rotors is the position which is displaced forty degrees from the position wherein that rotor has one-half of its periphery in substantial contact with one-half of the inner surface of the cylindrical body in which that rotor rotates and reciprocates.

The linear speeds at which the surfaces of the generally-elliptical openings 122 and 132 of FIGS. 1–9 move during each revolution of the rotor 80 will not be identical to the linear speed of the surface of the output shaft 80 during each such revolution. As a result, sliding as well as rolling will occur between the surfaces of those generally-elliptical openings and the surface of that output shaft during each such revolution. If desired, anti-friction bearings could be mounted on that output shaft to have the outer races thereof, rather than the surface of that output shaft, bear against those generally-elliptical surfaces. In such event, the outer surfaces of those outer races would be some of the interacting surfaces which would provide the required restraint and required direction-reversal for the rotor 80. Similarly, if desired, a wide anti-friction bearing could be mounted on the output shaft 172 of FIGS. 10–12 to have the outer surfaces of the outer race thereof, rather than the surface of the output shaft 172, engage the surface of the generally-elliptical opening 192 of the rotor 170. In such event, the outer surface of that outer race would be one of the interacting surfaces which would provide the required restraint and required direction-reversal for the rotor 170.

If desired, a mechanical or electrical starting device could be mounted adjacent the output shaft 62 of FIGS. 1–9 to initiate rotation of that shaft when that shaft happens to be in a position wherein the moment arm which the rotor 80 can apply to that shaft is minimal. Such a starting device can be of standard and usual design. Similarly, if desired, a mechanical or electrical starting device could be mounted adjacent the output shaft 172 of FIGS. 10–12 to initiate rotation of that shaft when that shaft happens to be in a position wherein the moment arm which the rotor 170 can apply to that shaft is minimal. Such a starting device can be of standard and usual design. Again, if desired, a mechanical or electrical starting device could be mounted adjacent the output shaft 296 of FIGS. 13–15 to initiate rotation of that shaft when that shaft happens to be in a position wherein the moment arm which the rotor 304 can apply to that shaft is minimal. Such a starting device can be of standard and usual design.

Although the various seals shown by the drawing will preferably be made of metal, one or more of those seals could be made of other materials. For example, one or more of those seals could be made of ceramic material or of carbon.

Although steam is the preferred propulsive fluid for the power-converting devices of FIGS. 1–15, whenever those devices are used as engines or motors, other propulsive fluids could be used. For example, compressed air, compressed non-corrosive gases, non-corrosive heated vapors, and the like could be used as the propulsive fluids for those devices. Steam is the preferred propulsive fluid, because of its availability, low cost and expansion capability, and non-corrosive heated vapors are desirable because of their expansion capabilities. Compressed air is desirable because of its availability and low cost.

The apex seals for the rotors 80, 170 and 304 preferably will have the U-shaped configurations shown for the apex seals in my said patent. That is why the apex seals 106 and 110 are shown longer in FIG. 2 then they are shown in FIG. 5. That also is why the apex seals 186 and 188 are shown longer in FIG. 10 than they are shown in FIG. 12.

Figure 16:
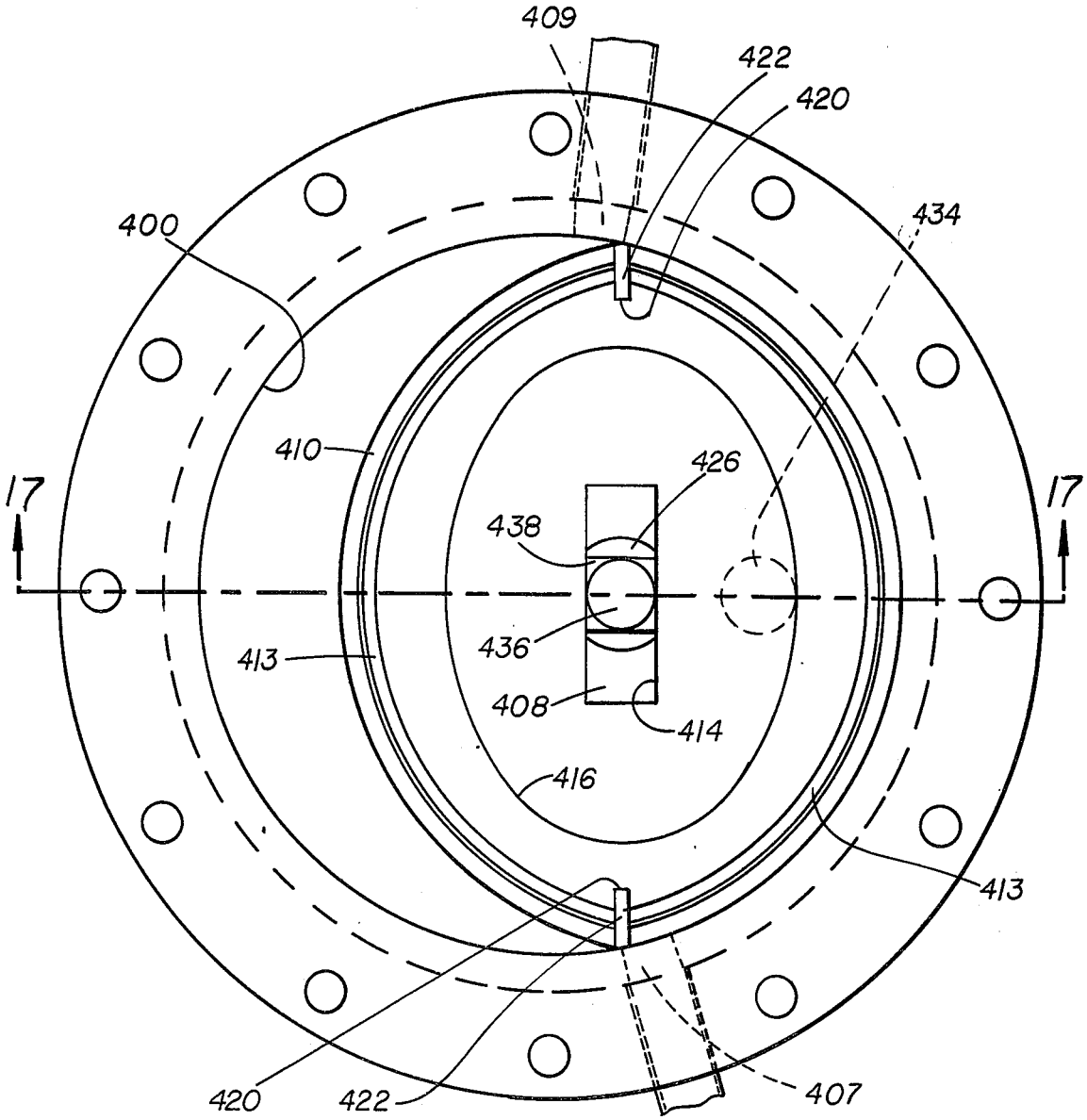
FIG. 16 is a side elevational view of a fourth preferred embodiment of power-converting device provided by the present invention, and it shows that device after one of the side plates thereof has been removed.
Figure 17:
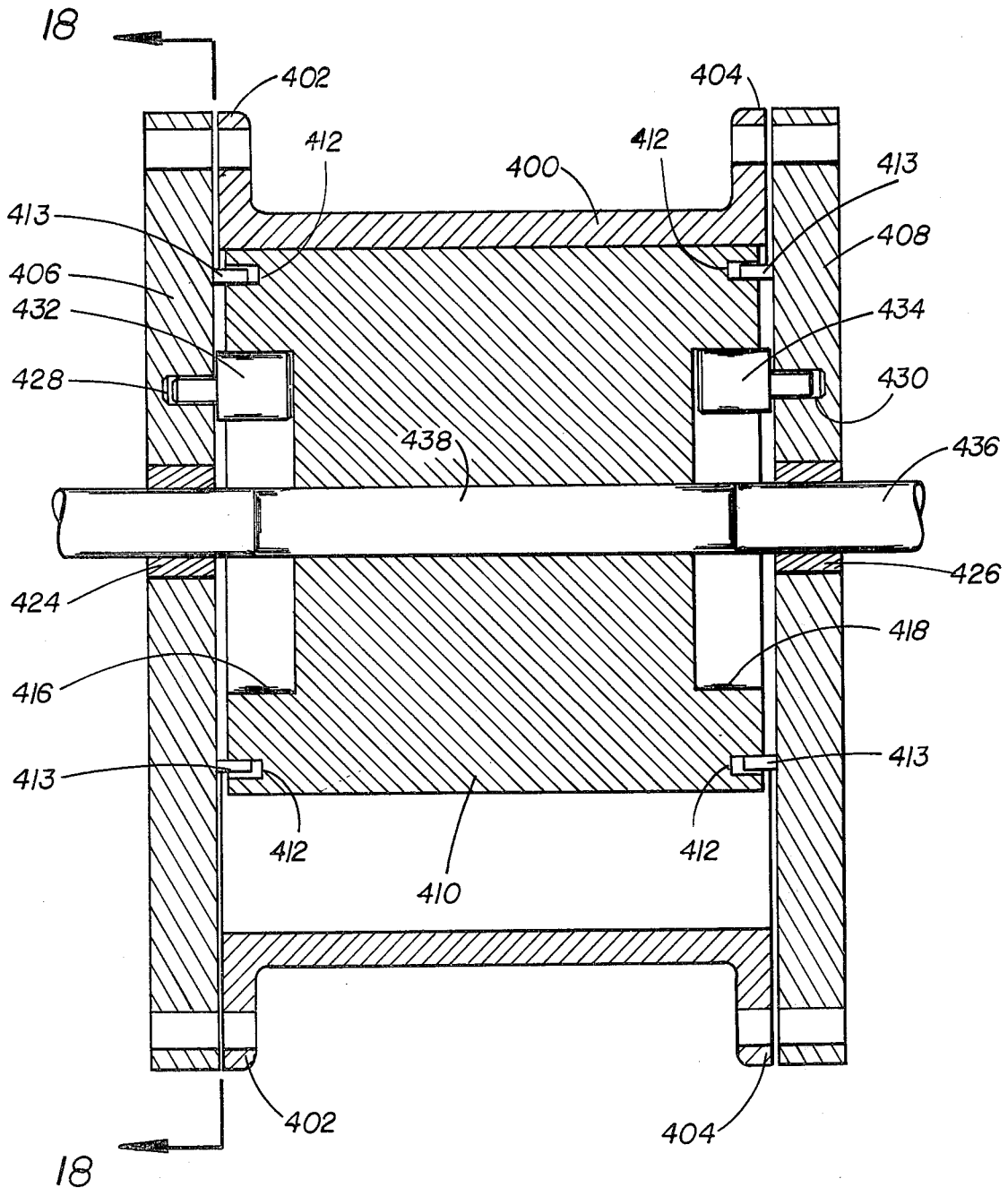
FIG. 17 is a sectional view through the device of FIG. 16, and it is taken along the plane indicated by the line 17—17 in FIG. 16.
Figure 18:
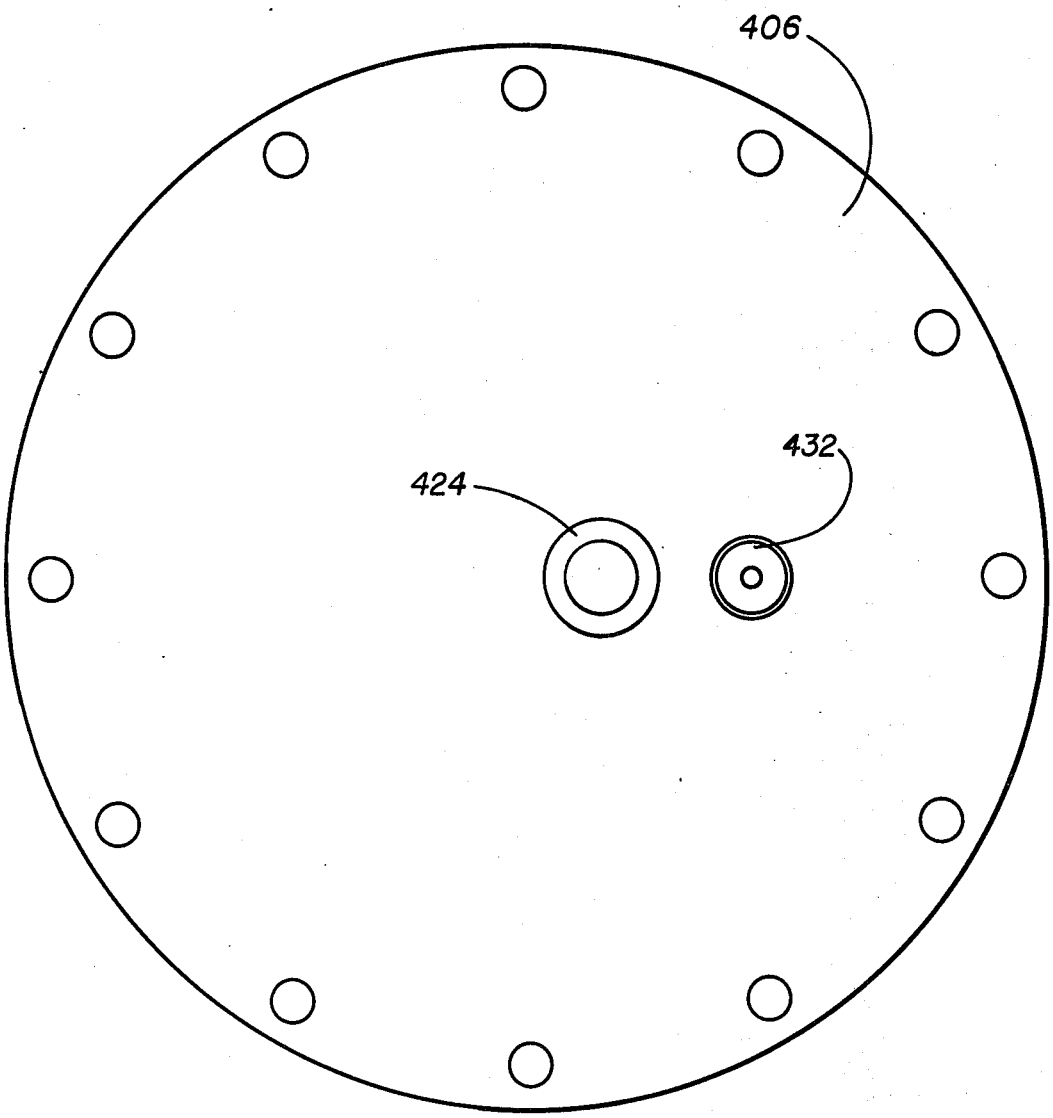
FIG. 18 is an elevational view of one of the side plates of the device of FIG. 16, and it is taken along the plane indicated by the line 18—18 in FIG. 17.

Referring particularly to FIGS. 16–18, the numeral 400 denotes the cylindrical body of a further preferred embodiment of power-converting device which is provided by the present invention. That cylindrical body has annular flanges 402 and 404, as shown particularly by FIG. 17. Side plates 406 and 408 are disposed in register with those flanges; and gaskets, not shown, are interposed between those flanges and those side plates. Screws, not shown, will pass inwardly through openings in the side plates 406 and 408 and seat in threaded sockets in the flanges 402 and 404 to enable those gaskets to provide fluid-tight engagements between those side plates and those flanges.

The numeral 407 denotes an inlet port which admits fluid to the cylindrical body 400. The numeral 409 denotes an outlet port which permits fluid to pass from that cylindrical body. Suitable pipes extend to that inlet and outlet port.

Figure 19:
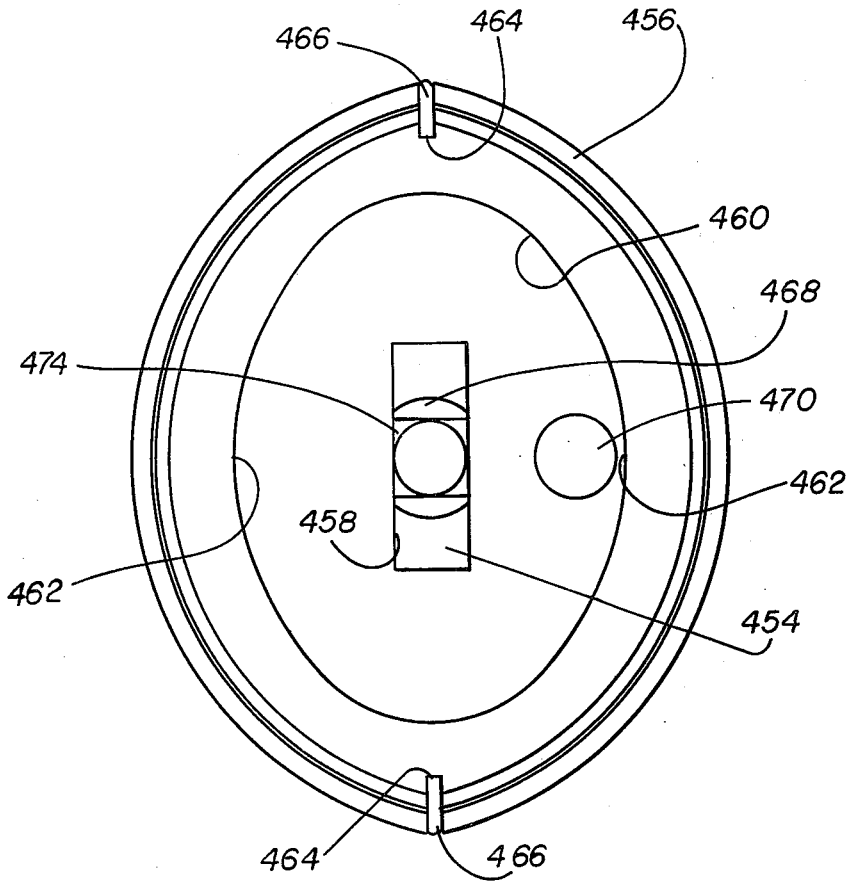
FIG. 19 is a side elevational view of a rotor which could be substituted for the rotor of FIGS. 16 and 17.

The numeral 410 generally denotes the rotor of the power-converting device of FIGS. 17–19; and that rotor is generally elliptical in side elevation. That rotor has arcuate grooves 412 in the side faces thereof to accommodate side seals 413 which bear against the inner faces of the side plates 406 and 408. Suitable springs, not shown, will be interposed between the inner faces of those side seals and the inner ends of the grooves 412. The numeral 414 denotes a rectangular slot which extends through the rotor 410, as indicated particularly by FIG. 16; and that slot has a major axis which is coincident with the major axis of that rotor. The numerals 416 and 418 denote recesses in the sides of rotor 410 which have substantially-elliptical walls, as indicated particularly by FIGS. 16 and 17. The numeral 420 denotes grooves in the rotor 410 for end seals 422; and those grooves lie on the major axis of that rotor. Springs, not shown, are provided within the grooves 420 to urge the end seals 422 against the inner surface of the cylindrical body 400.

The numerals 424 and 426 denote bushings which are mounted within openings in the side plates 406 and 408, respectively. As indicated particularly by FIG. 17, those bushings define an axis which is eccentric of the cylindrical body 400. Threaded sockets 428 and 430 are provided in the inner faces of the side plates 406 and 408, respectively; and those sockets are coaxial. Rollers 432 and 434 are rotatably mounted on threaded pins which are seated within the threaded sockets 428 and 430. The roller 432 extends into, and bears against the substantially-elliptical wall of, the recess 416; and the roller 434 extends into, and bears against the substantially-elliptical wall of, the recess 418. Those rollers define an axis which intersects the minor axis of the rotor 410 whenever axis is in its zero position.

The numeral 436 denotes a shaft which has a square section 438 intermediate circular end sections. That square section is disposed within the rectangular slot 414 in the rotor 410; and that square section and that rectangular slot force the rotor 410 to rotate with the shaft. The cylindrical outer ends of the shaft are held by, and rotate relative to, the bushings 424 and 426.

The power-converting device of FIGS. 16–18 is similar to the power-converting devices of FIGS. 13–15 in that the shaft makes a revolution each time the rotor makes a revolution. As that rotor rotates in the clockwise direction in FIG. 16, the end seals 422 will remain in continuous engagement with the generally-cylindrical inner surface of the cylindrical body 400, and the side seals 413 will remain in continuous engagement with the inner surfaces of the side plates 406 and 408. The zero position of the rotor 410 is shown in FIG. 16; and that rotor will assume that position at the end of each one hundred and eighty degrees of rotation.

Where the power-converting device is to be used as an engine, steam or some other propulsive fluid will be introduced through the inlet port 407 to rotate the rotor 410; and spent propulsive fluid will exhaust through the outlet port 409. The rotation of that rotor will effect concurrent rotation of the shaft. Where, however, the power-converting device is to be used as a pump, a suitable source of power will be connected to the shaft 436 to rotate it; and that shaft will rotate the rotor 410.

Fluid will be drawn into the cylindrical body 400 through the inlet port 407, and fluid will be ejected through the outlet port 409.

As the rotor 410 rotates, the substantially-elliptical wall of the recess 416 will be engaged by the surface of the roller 432; and the substantially-elliptical wall of the recess 418 will be engaged by the surface of the roller 434. Those rollers are free to rotate at angular speeds which will enable the linear speeds of the peripheries of those rollers to equal the linear speeds of the substantially-elliptical walls of the recesses 416 and 418. This is important in minimizing drag forces between those rollers and the rotor 410, and also is important in minimizing the wear between those rollers and that rotor.

As the major axis of the rotor 410 approaches the plane indicated by the line 17—17 in FIG. 16, that rotor will be shifting from right to left; and it will tend to continue to shift from right to left as its major axis moves into that plane. However, the rollers 432 and 434 will coact with the substantially-elliptical walls of the recesses 416 and 418 to gently and smoothly halt the shifting of that rotor from right to left in FIG. 16, and will start that rotor shifting from left to right. In doing so, those rollers and those substantially-elliptical walls perform the function which is performed by the shaft 62 and the substantially-elliptical openings 122 and 132 of FIGS. 2–9, by the shaft 172 and the substantially-elliptical surface 192 of FIGS. 10–12, and by the rollers 348, 352, 356 and 360 and the grooves 284 and 290 of FIGS. 13–15. The construction of FIGS. 16–18 bears a greater resemblance to the structure of FIGS. 13–15 than it does to the structures of FIGS. 1–12; because the rectangular slot 414 in the rotor 410 accommodates the square section 438 of the shaft 436, and because the rollers 432 and 434 can have linear speeds at the surfaces thereof which equal the linear speeds of the walls which they engage. A principal advantage of the structure of FIGS. 16–18 over the structure of FIGS. 13–15 is that the walls of the recesses 416 and 418 can be substantially elliptical, whereas the groove 284 of FIGS. 14 and 15 and the groove 290 of FIG. 14 must have configurations which are neither circular nor substantially elliptical and, instead, are of very complex natures.

Referring particularly to FIG. 19, the numeral 456 denotes a rotor which is similar to the rotor 410 of FIGS. 16 and 17, in that it has a rectangular slot 458 which accommodates the square section 474 of a shaft. Further, the rotor 456 resembles the rotor 410 of FIGS. 16 and 17 in having recesses 460 in the sides thereof which have generally-elliptical walls. However, the rotor 456 differs from the rotor 410 in that the portions of the generally-elliptical walls, of the recesses 460, which are in register with the minor axis of rotor 456 are relieved as indicated at 462. Grooves 464 are provided for end seals 466.

The numeral 454 denotes one of the side plates of a cylinder in which the rotor 456 will be mounted; and the numberal 468 denotes a bushing which is disposed within an opening in that side plate. The numeral 470 denotes a roller which is rotatably mounted on the other side plate, not shown, of the cylinder; and a further roller, not shown, will be rotatably mounted on the side plate 454. Those rollers will be coaxial; and they will engage the generally-elliptical walls of the recesses 460 whenever the rotor 456 is between its forty degree and one hundred and forty degree positions. In engaging those walls, those rollers will limit momentum-induced movement of that rotor.

The rotor of FIGS. 16 and 17 is preferred; because that rotor enables the rollers 432 and 434 to continuously engage the substantially-elliptical walls of the recesses 416 and 418 in every position of that rotor. However, because the need of limiting momentum-induced movement of a rotor is significant only when the major axis of that rotor is between its forty and one hundred and forty degree positions, it is possible, as indicated by FIG. 19, to relieve portions of the generally-elliptical walls of the recesses 460.

For optimum operation, the rollers 432 and 434 should be located, as indicated by FIG. 16, on an axis which is intersected by the minor axis of the rotor 410 when that rotor is in its zero position. However, the power-converting device of FIGS. 16–18 would be operable, with commercially-acceptable reductions in efficiency, even if the axes of those rollers did not intersect that minor axis in that position of that rotor. Specifically, that power-converting device would be operable, with commercially-acceptable reductions in efficiency when the axes of those rollers are close—either on or within fifteen degrees of—to the minor axis of rotor 410 when that rotor is in its zero position.

Whereas the drawing and accompanying description have shown and described several preferred embodiments of the present invention it should be apparent to those skilled in the art that various changes may be made in the form of the invention without affecting the scope thereof.

What I claim is:

1. A power-converting device that comprises a chamber which has a generally-cylindrical inner wall, a generally-elliptical rotor which is disposed within said chamber and which has a major axis and a minor axis, a shaft, a first reciprocation-permitting surface on said shaft, a second reciprocation-permitting surface that is on said rotor and that rotates whenever said rotor rotates, said first and said second reciprocation-permitting surfaces being in engagement with each other to force said shaft and said rotor to rotate together, said reciprocation-permitting surfaces permitting relative reciprocal movement therebetween so said rotor can reciprocate along said major axis as it rotates within said chamber, a plurality of seals that are mounted on said rotor and that engage said inner wall of said chamber but permit rotation and reciprocation of said rotor relative to said chamber while providing a sealing action between said rotor and said inner wall of said chamber, an inlet port of said chamber which admits fluid, an outlet port of said chamber which exhausts fluid, and interacting surfaces which restrain said rotor against continued momentum-induced movement as said rotor approaches an end of its path of reciprocation along said major axis, said interacting surfaces being radially displaced from and being separate from, and in addition to, said shaft and said reciprocation-permitting surfaces, the areas of interaction of said interacting surfaces being displaced from the center of said chamber, one of said interacting surfaces being a non-linear track-like surface and another of said interacting surfaces being the surface of a roller, said interacting surfaces providing a rolling engagement therebetween.

2. A power-converting device as claimed in claim 1 wherein said one interacting surface is generally elliptical and is on said rotor, and wherein said roller is mounted on said chamber.

3. A power-converting device as claimed in claim 1 wherein said roller is close to a line that is defined by said minor axis whenever said rotor is in its zero position.

4. A power-converting device as claimed in claim 1 wherein said one interacting surface is generally elliptical and is on said rotor, wherein said roller is close to a line that is defined by said minor axis whenever said rotor is in its zero position, and wherein said roller is mounted on said chamber.

5. A power-converting device as claimed in claim 1 wherein said one interacting surface encircles but is displaced radially outwardly from said shaft, wherein said roller is close to a line that is defined by said minor axis whenever said rotor is in its zero position, and wherein said roller is displaced radially outwardly from said shaft but is located radially inwardly of said one interacting surface.

6. A power-converting device as claimed in claim 1 wherein said one interacting surface is not elliptical and is on said chamber, and wherein said roller is mounted on said rotor.

7. A power-converting device as claimed in claim 1 wherein one of said interacting surfaces is a groove, and wherein another of said interacting surfaces is a cam follower which extends into said groove.

8. A power-converting device that comprises a chamber which has a generally-cylindrical inner wall, a generally-elliptical rotor which is disposed within said chamber and which has a major axis and a minor axis, a shaft, a first reciprocation-permitting surface on said shaft, a second reciprocation-permitting surface that is on said rotor and that rotates whenever said rotor rotates, said first and said second reciprocation-permitting surfaces being in engagement with each other to force said shaft and said rotor to rotate together, said reciprocation-permitting surfaces permitting relative reciprocal movement therebetween so said rotor can reciprocate along said major axis as it rotates within said chamber, a plurality of seals that are mounted on said rotor and that engage said inner wall of said chamber but permit rotation and reciprocation of said rotor relative to said chamber while providing a sealing action between said rotor and said inner wall of said chamber, an inlet port of said chamber which admits fluid, an outlet port of said chamber which exhausts fluid, and interacting surfaces which restrain said rotor against continued momentum-induced movement as said rotor approaches an end of its path of reciprocation along said major axis, said interacting surfaces being radially displaced from and being separate from, and in addition to, said shaft and said reciprocation-permitting surfaces, one of said interacting surfaces being a track-like surface and another of said interacting surfaces being the surface of a roller, said interacting surfaces providing a rolling engagement therebetween, said one interacting surface encircling but being displaced radially outwardly from said shaft, and said roller being displaced radially outwardly from said shaft but being located radially inwardly of said one interacting surface.

9. A power-converting device that comprises a chamber which has a generally-cylindrical inner wall, a generally-elliptical rotor which is disposed within said chamber and which has a major axis and a minor axis, a shaft, a first reciprocation-permitting surface on said shaft, a second reciprocation-permitting surface that is on said rotor and that rotates whenever said rotor rotates, said first and said second reciprocation-permitting surfaces being in engagement with each other to force said shaft and said rotor to rotate together, said reciprocation-permitting surfaces permitting relative reciprocal movement therebetween so said rotor can reciprocate along said major axis as it rotates within said chamber, a plurality of seals that are mounted on said rotor and that engage said inner wall of said chamber but permit rotation and reciprocation of said rotor relative to said chamber while providing a sealing action between said rotor and said inner wall of said chamber, an inlet port of said chamber which admits fluid, an outlet port of said chamber which exhausts fluid, and interacting surfaces which restrain said rotor against continued momentum-induced movement as said rotor approaches an end of its path of reciprocation along said major axis, said interacting surfaces being radially displaced from and being separate from, and in addition to, said shaft and said reciprocation-permitting surfaces, one of said interacting surfaces being a track-like surface and another of said interacting surfaces being the surface of a roller, said interacting surfaces providing a rolling engagement therebetween, said one interacting surface encircling but being displaced radially outwardly from said shaft, said one interaction surface being generally elliptical and being on said rotor, said roller being displaced radially outwardly from said shaft but being located radially inwardly of said one interacting surface, and said roller being mounted on said chamber.

10. A power-converting device that comprises a chamber which has a generally cylindrical inner wall, a generally-elliptical rotor which is disposed within said chamber and which has a major axis and a minor axis, a shaft, a first reciprocation-permitting surface on said shaft, a second reciprocation-permitting surface that is on said rotor and that rotates whenever said rotor rotates, said first and said second reciprocation-permitting surfaces being in engagement with each other to force said shaft and said rotor to rotate together, said reciprocation-permitting surfaces permitting relative reciprocal movement therebetween so said rotor can reciprocate along said major axis as it rotates within said chamber, a plurality of seals that are mounted on said rotor and that engage said inner wall of said chamber but permit rotation and reciprocation of said rotor relative to said chamber while providing a sealing action between said rotor and said inner wall of said chamber, an inlet port of said chamber which admits fluid, and outlet port of said chamber which exhausts fluid, and interacting surfaces which restrain said rotor against continued momentum-induced movement as said rotor approaches and end of its path of reciprocation along said major axis, said interacting surfaces being radially displaced from and being separate from, and in addition to, said shaft and said reciprocation-permitting surfaces, one of said interacting surfaces being a track-like surface and another of said interacting surfaces being the surface of a roller, said interacting surfaces providing a rolling engagement therebetween, said one interacting surface encircling but being displaced radially outwardly from said shaft, said one interacting surface being generally elliptical and being on said rotor, said roller being displaced radially outwardly from said shaft but being located radially inwardly of said one interacting surface, said roller being close to a line that is defined by said minor axis whenever said rotor is in its zero position, and said roller being mounted on said chamber.

11. A power-converting device that comprises a chamber which has a generally-cylindrical inner wall, a generally-elliptical rotor which is disposed within said chamber and which has a major axis and a minor axis, a shaft, a first reciprocation-permitting surface that is rotatable to rotate whenever said shaft rotates, a second reciprocation-permitting surface that is on said rotor and that rotates whenever said rotor rotates, said first and said second reciprocation-permitting surfaces being in engagement with each other to force said first reciprocation-permitting surface and said second reciprocation-permitting surface to rotate together and thereby interrelate the rotation of said rotor and of said shaft, said reciprocation-permitting surfaces permitting relative reciprocal movement therebetween so said rotor can reciprocate along said major axis as it rotates within said chamber, a plurality of seals that are mounted on said rotor and that engage said inner wall of said chamber but permit rotation and reciprocation of said rotor relative to said chamber while providing a sealing action between said rotor and said inner wall of said chamber, an inlet port of said chamber which admits fluid, an outlet port of said chamber which exhausts fluid, and interacting surfaces which restrain said rotor against continued momentum-induced movement as said rotor approaches an end of its path of reciprocation along said major axis, said interacting surfaces being radially displaced from and being separate from, and in addition to, said shaft and said reciprocation-permitting surfaces, one of said interacting surfaces being generally-elliptical and another of said interacting surfaces being on a member which is close to a line that is defined by said minor axis whenever said rotor is in its zero position.

12. A power-converting device as claimed in claim 11 wherein said one interacting surface is on said rotor, and wherein said other interacting surface is on a member which is rotatable relative to said chamber and which also is rotatable relative to said rotor.

13. A power-converting device as claimed in claim 11 wherein said one interacting surface is on said rotor and wherein said other interacting surface is the surface of a roller which is supported by said chamber and which is rotatable relative to said chamber and which also is rotatable relative to said rotor.

* * * * *